US011475977B2

(12) United States Patent
Blaine

(10) Patent No.: US 11,475,977 B2
(45) Date of Patent: Oct. 18, 2022

(54) METHODS FOR CALIBRATING PORTIONING APPARATUS

(71) Applicant: John Bean Technologies Corporation, Chicago, IL (US)

(72) Inventor: George R. Blaine, Lake Stevens, WA (US)

(73) Assignee: John Bean Technologies Corporation, Chicago, IL (US)

( * ) Notice: Subject to any disclaimer, the term of this patent is extended or adjusted under 35 U.S.C. 154(b) by 654 days.

(21) Appl. No.: 15/832,354

(22) Filed: Dec. 5, 2017

(65) Prior Publication Data

US 2018/0158537 A1 Jun. 7, 2018

Related U.S. Application Data

(60) Provisional application No. 62/431,374, filed on Dec. 7, 2016.

(51) Int. Cl.
*G12B 13/00* (2006.01)
*B26D 5/00* (2006.01)
(Continued)

(52) U.S. Cl.
CPC ..... *G12B 13/00* (2013.01); *B26D 5/007* (2013.01); *B26F 3/004* (2013.01); *B26D 7/0616* (2013.01);
(Continued)

(58) Field of Classification Search
CPC .. B26D 5/007; B26D 2210/02; B26D 7/0658; B26D 7/0616; B26D 7/0625; G12B 13/00; B26F 3/004
See application file for complete search history.

(56) References Cited

U.S. PATENT DOCUMENTS 4,875,254 A 10/1989 Rudy et al.
5,241,365 A 8/1993 Haagensen
(Continued)

FOREIGN PATENT DOCUMENTS

CN 1552153 A 12/2004
CN 101274377 A 10/2008
CN 102651994 A 8/2012

OTHER PUBLICATIONS

VIP Equipment, Jet Series Operations Manual, Sep. 2015, MP Equipment, LLC, Gainseville, GA, 211 pages. (Year: 2015).*
(Continued)

*Primary Examiner* — Peter K Huntsinger
(74) *Attorney, Agent, or Firm* — Christensen O'Connor Johnson Kindness PLLC

(57) ABSTRACT

The calibrating system 100 includes a conveyance system 102 for carrying work products 104 arranged in multiple lanes extending along the conveyor to be trimmed and/or cut into portions P. A scanner 110 scans the work product and a cutter system 120 consisting of one or more cutters are arranged in an array or series of cutter assemblies for cutting the work products into end pieces P of desired sizes or other physical parameters. A processor/computer 150, using a scanning program or portioning program, determines how the work product may be portioned into one or more end piece product sets. The processor/computer using the portioning software then functions as a controller to control the cutter system 120 to portion the workpiece 104 according to the selected end product/pieces P.

25 Claims, 16 Drawing Sheets

(51) Int. Cl.
*B26F 3/00* (2006.01)
*B26D 7/06* (2006.01)

(52) U.S. Cl.
CPC ..... *B26D 7/0625* (2013.01); *B26D 7/0658* (2013.01); *B26D 2210/02* (2013.01)

(56) References Cited

U.S. PATENT DOCUMENTS

| | | | | |
|---|---|---|---|---|
| 5,324,228 | A | 6/1994 | Vogeley, Jr. | |
| 5,585,603 | A | 12/1996 | Vogeley, Jr. | |
| 5,585,605 | A | 12/1996 | Williams et al. | |
| 2006/0171581 | A1* | 8/2006 | Blaine ..... | B26D 7/30 382/141 |
| 2013/0341156 | A1 | 12/2013 | Vogeley, Jr. | |
| 2017/0210023 | A1 | 7/2017 | Hocker et al. | |

OTHER PUBLICATIONS

International Search Report and Written Opinion dated Mar. 20, 2018, issued in corresponding International Application No. PCT/US2017/064633, filed Dec. 5, 2017, 11 pages.
International Preliminary Report on Patentability dated Jun. 20, 2019, issued in corresponding International Application No. PCT/US2017/064633, filed Dec. 5, 2017, 7 pages.
First Office Action dated Sep. 3, 2020, issued in CN Application No. 201780074874.3, filed Dec. 5, 2017, 19 pages.

* cited by examiner

| Cutter | L/R Alignment | Samples | Std Dev |
|---|---|---|---|
| 1 | 33.32±0.32 mm | 10 | 0.44 mm |
| 2 | 31.32±0.36 mm | 10 | 0.50 mm |
| 3 | 34.01±0.40mm | 10 | 0.55 mm |
| 4 | 34.24±0.54 mm | 10 | 0.75 mm |
| 5 | 39.89±0.37 mm | 10 | 0.51 mm |
| 6 | 39.46±0.33 mm | 10 | 0.46 mm |

| Cutter | Delay | Samples | Std Dev |
|---|---|---|---|
| 1 | 1561.19±0.39 mm | 10 | 0.55 mm |
| 2 | 1997.15±0.40 mm | 10 | 0.56 mm |
| 3 | 2685.16±0.43 mm | 10 | 0.59 mm |
| 4 | 3121.72±0.52 mm | 10 | 0.73 mm |
| 5 | 3825.86±0.81 mm | 10 | 1.13 mm |
| 6 | 4261.73±0.76 mm | 10 | 1.06 mm |

METHODS FOR CALIBRATING PORTIONING APPARATUS

CROSS-REFERENCE TO RELATED APPLICATION

This application claims the benefit of Provisional Application No. 62/431,374, filed Dec. 7, 2016, disclosure of which is incorporated herein by reference.

FIELD OF THE INVENTION

The present invention pertains to the processing of workpieces, such as food products, using high speed portioning machines, and more particularly to the calibration of such portioning machines.

BACKGROUND

Workpieces, including food products, are portioned or otherwise cut into smaller pieces by processors in accordance with customer needs. Also, excess fat, bones, and other foreign or undesired materials are routinely trimmed from food products. It is usually highly desirable to portion and/or trim the food products into uniform sizes, for example, for steaks to be served at restaurants or chicken fillets used in frozen dinners or in chicken burgers.

Much of the portioning/trimming of workpieces, in particular food products, is now carried out with the use of high-speed portioning machines. These machines use various scanning techniques to ascertain the size and shape of the food product as it is being advanced on a moving conveyor. This information is analyzed with the aid of a computer to determine how to most efficiently portion the food product into optimum sizes. For example, a customer may desire chicken breast portions in two different weight sizes, but with no fat or with a limited amount of acceptable fat. The chicken breast is scanned as it moves on an infeed conveyor belt and a determination is made through the use of a computer as to how best to portion the chicken breast to the weights desired by the customer, with no or limited amount of fat, so as to use the chicken breast most effectively.

Portioning and/or trimming of the workpiece can be carried out by various cutting devices, including high-speed liquid jet cutters (liquids may include, for example, water or liquid nitrogen) or rotary or reciprocating blades, after the food product is transferred from the infeed to a cutting conveyor. In many high-speed portioning systems, several high-speed waterjet cutters are positioned along the length of a conveyor to achieve high throughput of the portioned/cut workpieces. Once the portioning/trimming has occurred, the resulting portions are off-loaded from the cutting conveyor and placed on a take-away conveyor for further processing or, perhaps, to be placed in a storage bin.

In order for accurate portioning or trimming to take place with cutting devices, such as high-speed waterjet cutters, it is necessary to calibrate the portioning system. In this regard, there needs to be correspondence between what is being viewed by the scanner and the placement or movement of the waterjet cutter so that the food products are accurately portioned into desirable sizes or weights, and also so that fat is accurately trimmed from the food products and bones or other foreign or undesirable materials are accurately excised from the food products.

It is necessary to calibrate the waterjet cutter in the lateral or cross-belt travel direction of the waterjet cutter as well as in the longitudinal or down-belt travel direction of the waterjet. Currently, this calibration is carried out by using simulated food products, for example, three-dimensional shapes formed from Play-Doh®. These Play-Doh shapes are placed on the conveyor and scanned as they pass by the scanning station, and then are cut by the waterjet cutter. In a typical calibration procedure, the portioner is programmed to cut the simulated work product in two halves of equal weight, a left half and a right half. After the cutting occurs, the two halves are weighed. If the weights of the two halves differ, the computer-operated controller program notes the difference between the two weights and "adjusts" the cross-belt position or offset of the waterjet cutter relative to a scanner datum. This process is repeated several times for each of the waterjet cutters being utilized.

FIGS. 1A, 1B and 1C illustrate three cuts of the simulated workpiece WP as it is being carried on a conveyor belt CB in the downstream direction indicated by the arrow. In FIG. 1A, the cutter is too far to the left and in FIG. 1B, the cutter is too far to the right. In FIG. 1C, the cutter is correctly positioned relative to the workpiece WP. In the situation of FIGS. 1A and 1B, the portioner control system adjusts the position or offset of the waterjet cutter being calibrated relative to the scanner datum.

Thereafter, the location of the waterjet cutters in the down-belt direction relative to the scanner is also calibrated. This can occur by programming the portioner to cut the test work product in two halves, a leading half and a trailing half. After the test product has been cut in this manner, the two halves are weighed, and if a difference exists in their weights, the portioner control system "adjusts" the distance or delay between the waterjet cutter and a datum point or line at the scanner. As in the calibration process for the lateral location of the waterjet cutter, the calibration of the down-belt location of the waterjet cutter relative to the scanner is performed typically up to ten times per cutter.

FIGS. 2A, 2B, and 2C illustrate three cuts of the simulated workpiece WP as the workpiece is being carried on a conveyor belt CB in the direction indicated by the arrow. In FIG. 2A, the cut of the workpiece occurs too soon, whereas in FIG. 2B, the cut of the workpiece occurs too late. In FIG. 2C, the cut of the workpiece occurs at the correct time so as to divide the workpiece into two equal-sized trailing and leading halves. In the situations of FIGS. 2A and 2B, the portioner control system adjusts the distance or delay between the waterjet cutter being calibrated and the datum point aligned at the scanner.

It can be appreciated that if eight waterjet cutters are utilized and for each cutter ten cuts are made to calibrate the cutters in the lateral or cross-belt direction, and ten additional cuts are made to calibrate the waterjet cutters in the down-belt direction, a total of 160 test pieces are cut and weighed. Typically, it may take up to at least three hours to calibrate the portioning apparatus. This is a significant amount of downtime, especially if calibration occurs routinely at least once a week or if calibration must take place after replacement or repair of the conveyor, waterjet cutter(s), or other components of the portioning apparatus.

Thus, it is desirable to develop a calibration methodology, which is not only accurate, but also faster than the currently used calibration procedure. The present disclosure seeks to address this particular need.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A method of calibrating a processing system having a scanner for scanning a workpiece carried on a conveyor and an actuator configured to move relative to the conveyor, the method including:

loading at least one target simulating the workpiece on the conveyor;

scanning the target for locating the target on the conveyor and ascertaining physical parameters of the target as the target is transported by the conveyor;

marking the target with the location or path of movement of the actuator relative to the target as the target is being transported by the conveyor;

removing the marked target from the conveyor;

reloading the marked target on the conveyor;

rescanning the marked target to locate the location or path of the movement of the actuator relative to the target; and calculating the position of the actuator relative to the location of the scanner in the direction laterally of the conveyor travel path and calibrating the position of the actuator relative to the scanner in the direction along the length of the conveyor travel path based on the located position or path of movement of the actuator relative to the target.

In accordance with a further aspect of the present disclosure, the actuator is selected from a group consisting of a cutter, a water jet cutter, an injection meter, a printing head, a stamping head, a drilling head, a piercing head, a nailing head, a stapling head, and a laser.

In accordance with a further aspect of the present disclosure, the marking of a target is performed by a step selected from the group consisting of cutting the target, cutting a shape in the target, piercing the target, applying indicia to the target, forming an indicia on the target, applying pain to the target, applying a design to the target, forming a hole in the target, drilling a hole in the target, piercing the target, and burning a shape in the target.

In accordance with a further aspect of the present disclosure, the target is composed of one or more of the following materials: foamed plastic, foamed thermoplastic, foamed rubber, foamed synthetic rubber, polyactic acid, organic food-based materials, rubber, synthetic rubber, paper, cardboard, and corrugated cardboard.

A method for calibrating a portioning system having a scanner for scanning a workpiece carried on a conveyor and at least one cutter configured to move laterally relative to the conveyor travel path and along the length of the conveyor travel path, the method comprising:

loading at least one target simulating a workpiece on the conveyor;

scanning the target for locating the target on the conveyor and ascertaining physical parameters of the target as the target is transported by the conveyor;

cutting the target with at least one cutter in a specific cutting pattern as the target is being transported by the conveyor;

removing the cut target from the conveyor;

reloading the cut target on the conveyor;

rescanning the cut target to analyze the position of the cutting pattern relative to the target; and based on the position of the cutting pattern, calibrating the position of the at least one cutter relative to the location of the scanner in the direction laterally of the travel direction of the conveyor, and calibrating the position of the at least one cutter relative to the scanner in the direction along the length of travel of the conveyor based on the analyzed position of the cutter pattern on the target.

In accordance with a further aspect of the present disclosure, a plurality of targets are spaced along the length of the conveyor and/or spaced across the width of the conveyor. The locations of the targets located across the width of the conveyor can correspond to the location or locations across the conveyor at which workpieces are carried by the conveyor.

In accordance with a further aspect of the present disclosure, the specific cutting patterns comprise shapes cut in the target with the at least one cutter, and wherein the shapes are selected from the group consisting of circles, ovals, triangles, squares, starts, and polyhedrons. Further, the shapes cut from the workpieces are arranged in a specific pattern on the target and/or the shapes cut from the target are arranged along the direction of travel of the conveyor.

In accordance with a further aspect of the present disclosure, the shapes cut from the workpieces are arranged parallel to one side of the conveyor.

In accordance with a further aspect of the present disclosure, the shapes cut from the target are removed from the target prior to reloading the target on the conveyor.

In accordance with a further aspect of the present disclosure, the cutting of a target with the at least one cutter comprises cutting preselected shapes in the target, and further the shapes cut from the target are removed from the target prior to reloading the target on the conveyor.

In accordance with a further aspect of the present disclosure, the portioning system comprises a plurality of cutters, and each cutter cuts a unique shape on the target. The unique shapes may be cut in a plurality of targets.

In accordance with a further aspect of the present disclosure, the portioning system is configured to recognize upon rescanning of the targets each specific target originally scanned by the scanner and then cut by the at least one cutter. Further, the portioning system recognizes one or more physical parameters of the targets ascertained by the portioning system when originally scanned by the scanner. The one or more physical parameters of the targets recognized by the portioning system are selected from the group consisting of target length, width, aspect ratio, thickness, thickness profile, contour, outer contour, outer perimeter size, and/or outer perimeter shape.

In accordance with a further aspect of the present disclosure, the physical parameters comprise indicia located on the target or aspects of a pattern cut into the target. The indicia may comprise an identification code applied to the target. Further, the identification code comprises a serial number applied to the target at the time of manufacture, an identification code applied to the target at the time of carrying out the calibration method, a bar code, a 1D bar code, a 2D bar code, a 3D bar code, a QR code, and/or an RFID tag.

In accordance with a further aspect of the present disclosure, the pattern cut into the target comprises a unique pattern cut into the targets by each of the at least one cutter. The unique patterns are selected from the group consisting of a specific cutter using the same pattern in a target at least twice; at least one of the cutters cutting a different unique pattern in the target for each cut, different arrangements or combinations of the same pattern cut into the targets in different arrangements or combinations of different patterns cut into the target.

In accordance with a further aspect of the present disclosure, the calibrating method further comprises analyzing the physical parameters of the target upon rescanning of the target to match the rescanned target to the corresponding originally scanned target. A transformation of the physical parameters of the target ascertained during the original scanning of the target to the physical parameters of the target ascertained during the rescanning of the target may be carried out to assist in analyzing the position of a cut pattern relative to the target.

In accordance with a further aspect of the present disclosure, the calibrating of the at least one cutter comprises determining the position of at least one cutter during cutting of the specific pattern in the target and storing the determined position of the at least one cutter during cutting relative to the reference locations associated with the scanner. The determining of the position of the at least one cutter is based on determining the location of a physical attribute of the specific pattern cut in the target. The specific attribute may comprise the centroid of the cutting pattern.

In accordance with a further aspect of the present disclosure, the position of the at least one cutter is calibrated at a plurality of locations across the width of the conveyor. These locations across the width of the conveyor may correspond to locations at which workpieces are carried by the conveyor.

In accordance with a further aspect of the present disclosure, a datum is established relative to the location of the scanner for the location of the at least one cutter in the direction laterally to the direction of movement of the conveyor. A datum is also established relative to the location of the scanner for the location of the at least one cutter in the direction along the direction of movement of the conveyor.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1A:
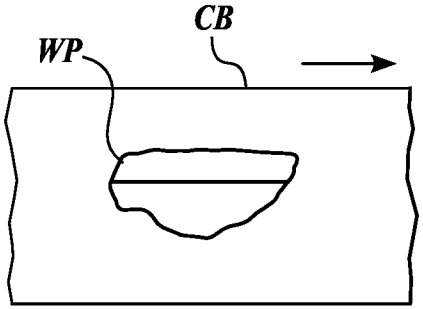
Fig. 1A. (PRIOR ART)
FIGS. 1A, 1B, and 1C illustrate the cutting of a simulated workpiece in an existing process for calibrating a portioning machine wherein the simulated piece is laterally divided.
Figure 1B:
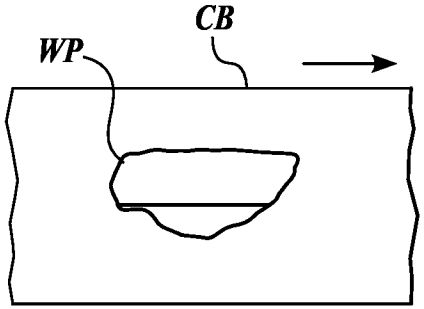
Fig. 1B. (PRIOR ART)
Figure 1C:
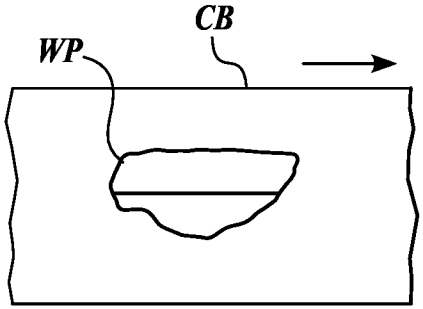
Fig. 1C. (PRIOR ART)
Figure 2A:
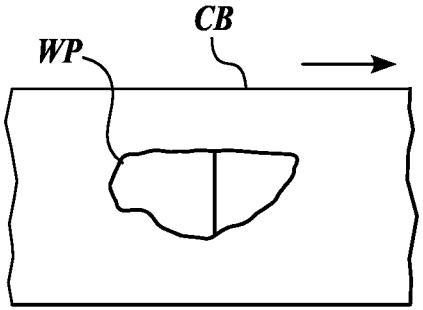
Fig. 2A. (PRIOR ART)
FIGS. 2A, 2B, and 2C illustrate cuts made in a simulated workpiece during calibration of a portioning machine using the existing method, wherein the workpiece is divided into a leading half and a trailing half.
Figure 2B:
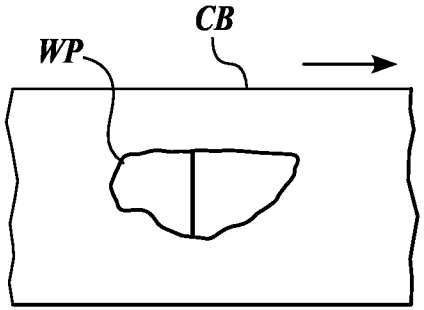
Fig. 2B. (PRIOR ART)
Figure 2C:
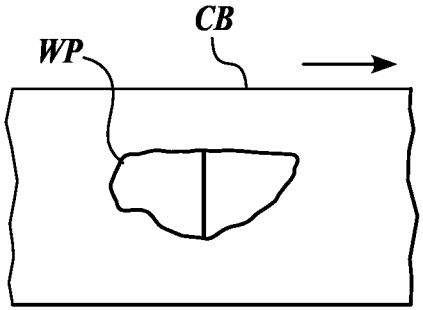
Fig. 2C. (PRIOR ART)

The description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to "directions," such as "forward," "rearward," "front," "back," "ahead," "behind," "upward," "downward," "above," "below," "top," "bottom," "right hand," "left hand," "in," "out," "extended," "advanced," "retracted," "proximal," and "distal." These references and other similar references in the present application are only to assist in helping describe and understand the present disclosure and are not intended to limit the present invention to these directions.

The present application may include modifiers such as the words "generally," "approximately," "about," or "substantially." These terms are meant to serve as modifiers to indicate that the "dimension," "shape," "temperature," "time," or other physical parameter in question need not be exact, but may vary as long as the function that is required to be performed can be carried out. For example, in the phrase "generally circular in shape," the shape need not be exactly circular as long as the required function of the structure in question can be carried out.

In the following description and in the accompanying drawings, corresponding systems, assemblies, apparatus and units may be identified by the same part number, but with an alpha suffix. The descriptions of the parts/components of such systems assemblies, apparatus, and units that are the same or similar are not repeated so as to avoid redundancy in the present application.

In the present application and claims, references to "food," "food products," "food pieces," and "food items,"

are used interchangeably and are meant to include all manner of foods. Such foods may include, for example, meat, fish, poultry, fruits, vegetables, nuts, or other types of foods. Also, the present systems, apparatus and methods are directed to raw food products, as well as partially and/or fully processed or cooked food products.

Further, the systems, apparatus and methods disclosed in the present application and defined in the present claims, though specifically applicable to food products or food items, may also be used outside of the food area. Accordingly, the present application and claims reference "work products" and "workpieces," which terms are synonymous with each other. It is to be understood that references to work products and workpieces also include food, food products, food pieces, and food items.

The systems, apparatus and methods of the present disclosure include the scanning of workpieces, including food items, to ascertain physical parameters of the workpiece comprising the size and/or shape of the workpiece. Such size and/or shape parameters may include, among other parameters, the length, width, aspect ratio, thickness, thickness profile, contour, outer contour, outer perimeter, outer perimeter configuration, outer perimeter size, outer perimeter shape, and/or weight of the workpiece. With respect to the physical parameters of the length, width, length/width aspect ratio, and thickness of the workpieces, including food items, such physical parameters may include the maximum, average, mean, and/or median values of such parameters. With respect to the thickness profile of the workpiece, such profile can be along the length of the workpiece, across the width of the workpiece, as well as both across/along the width and length of the workpiece.

As noted above, a further parameter of the workpiece that may be ascertained, measured, analyzed, etc. is the contour of the workpiece. The term contour may refer to the outline, shape, and/or form of the workpiece, whether at the base or bottom of the workpiece or at any height along the thickness of the workpiece. The parameter term "outer contour" may refer to the outline, shape, form, etc., of the workpiece along its outermost boundary or edge.

The parameter referred to as the "perimeter" of the workpiece refers to the boundary or distance around a workpiece. Thus, the terms outer perimeter, outer perimeter configuration, outer perimeter size, and outer perimeter shape pertain to the distance around, the configuration, the size and the shape of the outermost boundary or edge of the workpiece.

The foregoing enumerated size and/or shape parameters are not intended to be limiting or inclusive. Other size and/or shape parameters may be ascertained, monitored, measured, etc., by the present system, apparatus and method. Moreover, the definitions or explanations of the specific size and/or shape parameters discussed above are not meant to be limiting or inclusive.

Overall System

Figure 3:
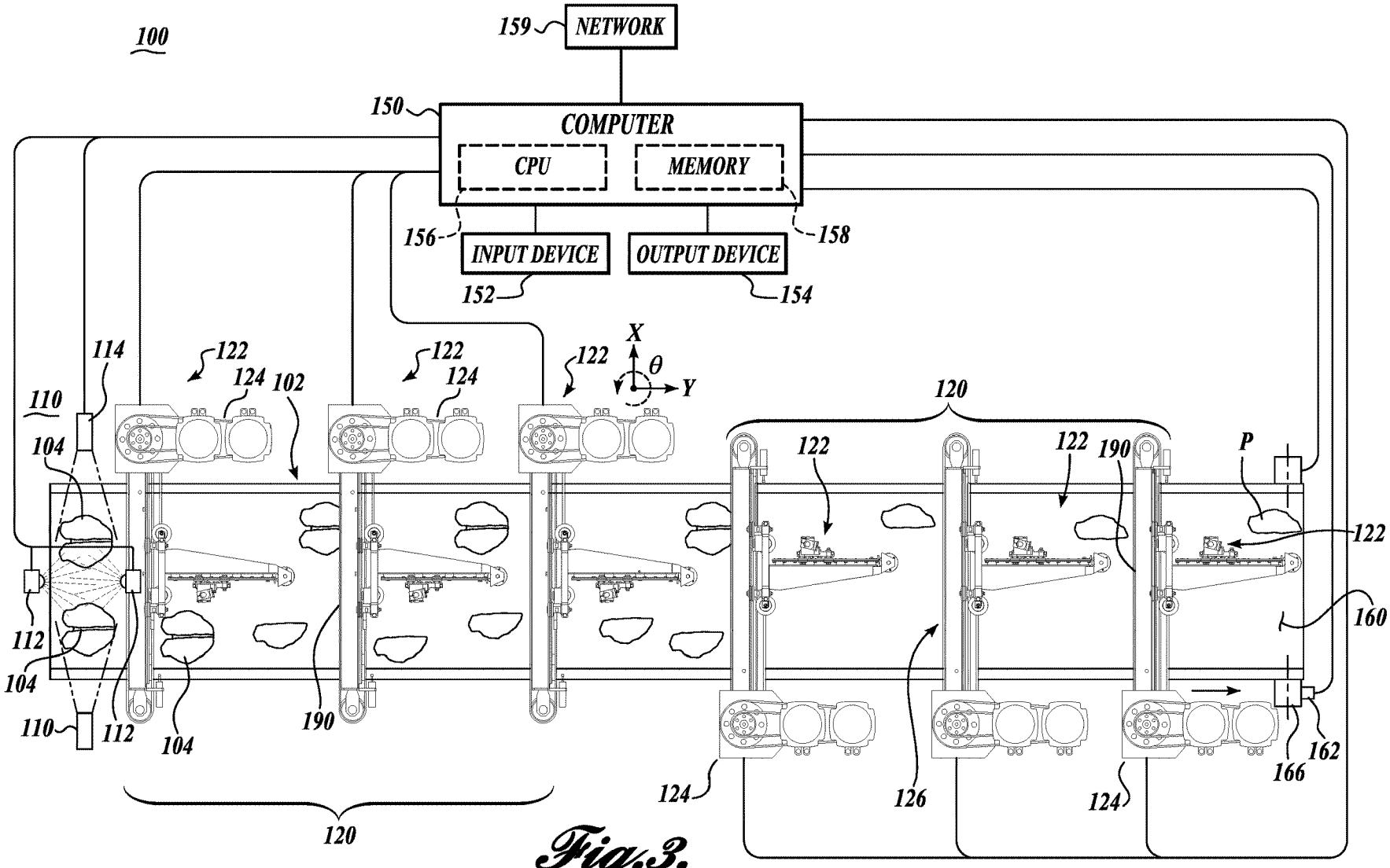
FIG. 3 illustrates a portioning system utilizing the calibration system and methods of the present disclosure.

FIG. 3 schematically illustrates a system 100 for cutting and unloading portions suitable for implementing an embodiment of the present disclosure. The system 100 includes a moving support surface in the form of a conveyance system 102 for carrying work products 104, which may be arranged in multiple lanes or windrows, extending along the conveyance system, to be trimmed and/or cut into portions P. The work products 104 may be a food product, such as meat, poultry, or fish, that are spaced along the conveyance system. Other types of work products may include items composed of, for example, fabric, rubber, cardboard, plastic, wood or other types of material spaced along the conveyance system.

In a scanning aspect of the present disclosure, the system 100 includes a scanner 110 for scanning the work products 104. In a cutting/trimming/portioning aspect of the present disclosure, the system 100 includes a cutter system 120 composed of one or more cutter assemblies/units/apparatus 122, which may be arranged in an array or series of cutter assemblies, for cutting/trimming/portioning the work products 104 into end pieces P of desired sizes or other physical parameters. The cutter assemblies 122 are carried by a powered carrier system 124 to move the cutter assemblies longitudinally and laterally relative to the conveyance system.

The conveyor system 102, scanner 110, and cutting system 120 are coupled to and controlled by a processor or computer 150. As illustrated in FIG. 3, the processor/computer 150 includes an input device 152 (keyboard, mouse, touchpad, etc.) and an output device 154 (monitor, printer). The computer 150 also includes a CPU 156 and at least one memory unit 158. Rather than using a single processor or computer, one or more of the conveyor systems, scanners and cutting systems may utilize its own processor or computer. Also, the processor/computer may be connected to a network 159 that ties system 100 to other aspects of the processing of workpieces 104, such as downstream processing of portions P.

Generally the scanner 110 scans the work products 104 to produce scanning information representative of the work products 104, and forwards the scanning information to the processor/computer 150. The processor/computer, using a scanning program, analyzes the scanning data to determine the location of the work products on the conveyance system and develop a length, width, area, and/or volume distribution of the scanned work product. The processor/computer 150 may also develop a thickness profile of a scanned work product. The processor/computer 150 can then model the work product to determine how the work product may be divided, trimmed, and/or cut into end pieces P composed of specific physical criteria, including, for example, shape, area, weight, and/or thickness. In this regard, the processor/computer 150 takes into consideration that the thickness of the work product may be altered, either before or after the work product is cut by the cutter system 120, or by a slicer, not shown. The processor/computer 150, using the scanning program or portioning program, determines how the work product may be portioned into one or more end piece product sets. The processor/computer using the portioning software then functions as a controller to control the cutter system 120 to portion the workpiece 104 according to the selected end product/pieces P.

Conveyance System

Figure 4:
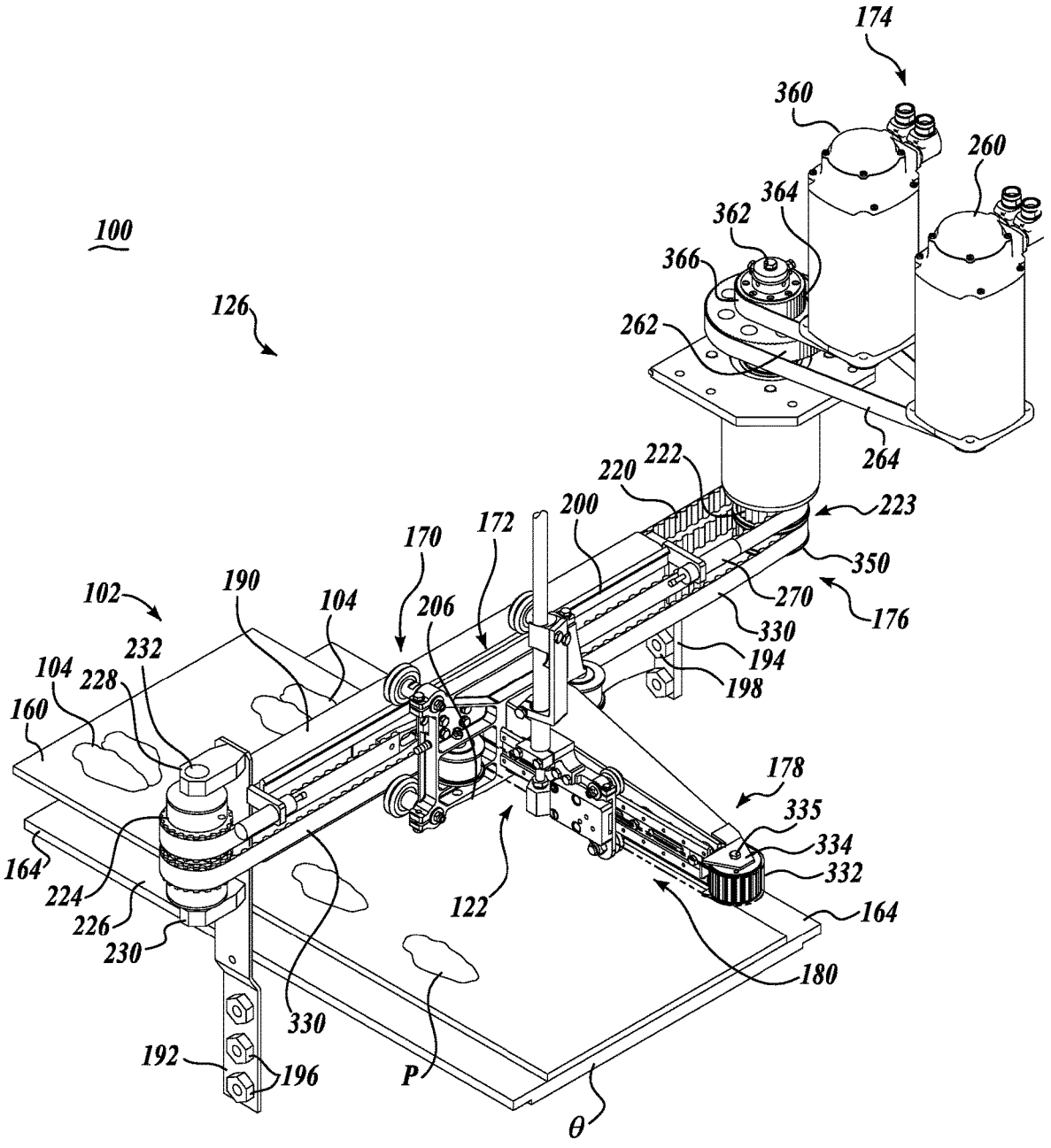
FIG. 4 is a pictorial view of a carrier system of the portioning system of FIG. 3.

Referring specifically to FIGS. 3 and 4, the conveyance system 102 includes a moving belt 160 that slides over an underlying support or bed 164. The belt 160 is driven by drive rollers carried by a frame structure (not shown) in a standard manner. The drive rollers are in turn driven at a selected speed by a drive motor 166, also in a standard manner. The drive motor 166 can be composed of a variable speed motor to thus adjust the speed of the belt 160 as desired, as the work product 104 is carried past scanner 110 and cutter system 120.

An encoder 162 is integrated into the conveyance system 102, for example, at drive motor 166 to generate electrical pulses at fixed distance intervals corresponding to the forward movement of the conveyor belt 160. This information is routed to processor/computer 150 so that the location(s) of the particular work product 104, or the portions P cut from the work product, can be determined and monitored as the work product or portions travel along system 100. This information can be used to position cutter assemblies 122, as well as for other purposes.

Scanning

Describing the foregoing system 100 and corresponding method in more detail, the conveyor 102 carries the work products 104 beneath the scanning system 110. The scanning system may be of a variety of different types, including video cameras 112 to view the work products 104 illuminated by one or more light sources. Light from the light source 114 is extended across the moving conveyor belt 160 of the conveying system 102 to define a sharp shadow or light stripe line 116, with the area forwardly of the transverse beam being dark. See FIG. 9. When no work product 104 is being carried by the conveyor belt 160, the shadow line/light stripe 116 forms a straight line across the conveyor belt. However, when the work products 104 pass across the shadow line/light stripe, the upper, irregular surface of the work product produces an irregular shadow line/light stripe as viewed by video cameras 112 angled downwardly on the work product and the shadow line/light stripe. The video cameras detect the displacement of the shadow line/light stripe 116 from the position it would occupy if no work product were present on the conveyor belt 160. This displacement represents the thickness of the work product along the shadow line/light stripe. The length of the work product is determined by the distance of the belt travel that shadow line/light stripes are created by the work product. In this regard, the encoder 162 integrated into the conveyance system generates pulses at fixed distance intervals corresponding to the forward movement of the conveyor belt 160.

Figure 10:
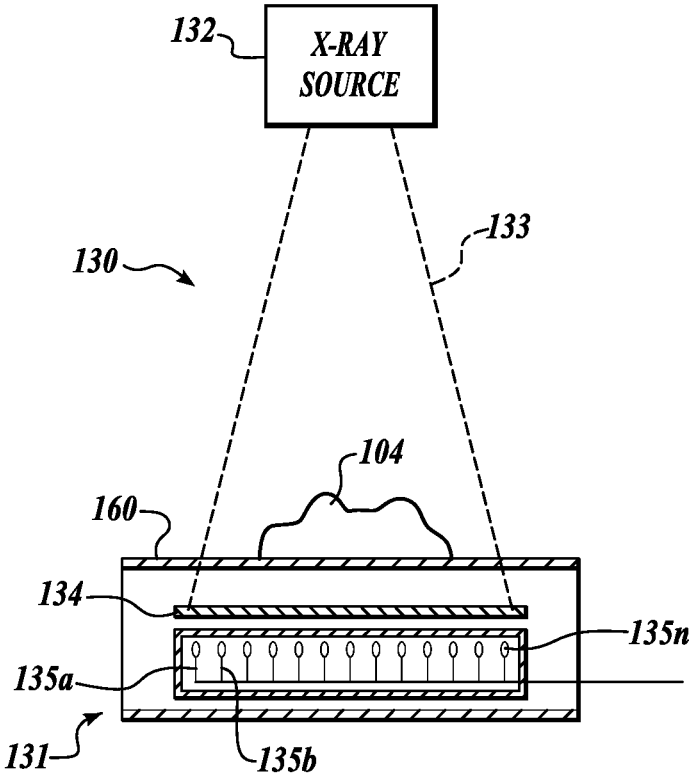
FIG. 10 is a schematic view of an X-ray scanner.

In lieu of a video camera, the scanning station may instead utilize an X-ray apparatus 130 for determining the physical characteristics of the work product, including its shape, mass, and weight, see FIG. 10. Generally, X-rays are attenuated as they pass through an object in proportion to the total mass of the material through which the X-rays pass. The intensity of the X-rays received at an X-ray detector, such as detector 131, after they have passed through an object such as work product 104 is therefore inversely proportional to the density of the object. For example, X-rays passing through a chicken bone, or a fish bone, which have a relatively higher density than the chicken flesh or the fish flesh, will be more attenuated than the X-rays that pass only through the meat of the chicken or the fish. Thus, X-rays are suited for inspecting workpieces to detect the existence of undesirable material having a specific density or X-ray modification characteristics. A general description of the nature and use of X-rays in processing workpieces can be found in U.S. Pat. No. 5,585,603, incorporated herein by reference.

Referring to FIG. 10, the X-ray scanning system 130 includes an X-ray source 132 for emitting X-rays 183 toward workpiece 104. An array of X-ray detectors 131 is located adjacent and beneath the upper run of conveyor belt 160 for receiving the X-rays 133 that have passed through the workpiece 104 when the workpiece is within the scope of the X-rays 133. Each of the X-ray detectors in the array 131 generates a signal corresponding to an intensity of the X-rays impinging on the X-ray detector 131. The signals generated by the X-ray detector array are transmitted to processor 150. The processor processes these signals to determine the existence and location of any undesirable material present in the workpiece 104.

As noted above, the system 100 may include a position sensor in the form of encoder 162 that generates the signal indicative of the position of the workpiece 104 along the length of conveyor 102 as the workpiece 104 is moved on the conveyor with respect to the X-ray system 130. The position of the workpiece along the length and width of the conveyor 102 can be ascertained by the X-ray system. The X-ray system can also provide other information with respect to a workpiece, including physical parameters pertaining to the size and/or shape of the workpiece, such as for example, the length, width, aspect ratio, thickness, thickness profile, contour, outer contour configuration, perimeter, outer perimeter configuration, outer perimeter size and/or shape, and/or weight, as well as other aspects of the physical parameters of the workpiece. With respect to the outer perimeter configuration of the workpiece 104, the X-ray detector system can determine locations along the outer perimeter of the workpiece based on an X-Y coordinate system or other coordinate system.

Continuing to refer specifically to FIG. 10, the X-ray detector array 131 includes a layer of scintillator material 134 located above a plurality of photodiodes 135*a*-135*n*. The X-ray source 132 is located a sufficient distance above the conveyor belt 160 so that the X-rays 133 emitted from the X-ray source 132 completely encompass the width of the X-ray detector array 131. The X-rays 133 pass through the workpiece 104, through the conveyor belt 160 and then impinge upon the layer of scintillator material 134. Since the photodiodes 135*a*-135*n* respond only to visible light, the scintillator material 134 is used to convert the X-ray energy impinging thereupon into visible light flashes that are proportional to the strength of the received X-rays. The photodiodes 135 generate electrical signals having an amplitude proportional to the intensity of the light received from the scintillator material 66. These electrical signals are relayed to the processor 150.

The photodiodes 135 can be arranged in a line across the width of the conveyor belt 160 for detecting X-rays passing through a "slice" of the workpiece 104. Alternative photodiode layouts are possible, of course. For example, the photodiodes may be positioned in several rows into a grid square to increase the scanning area of the X-ray detector 130.

The data and information measured/gathered by the scanning device(s) are transmitted to the processor/computer 150, which records and/or notes the location of the work products 104 on the conveyor, as well as data pertaining to, inter alia, the lengths, widths, and thicknesses of the work products about the entire work products. With this information, the processor, operating under the scanning system software, can develop an area profile as well as a volume profile of the work products. Knowing the density of the work products, the processor can also determine the weight of the work products or segments or sections thereof.

Although the foregoing description discusses scanning by use of a video camera and light source, as well as by use of X-rays, other three-dimensional scanning techniques may be utilized. For example, such additional techniques may be by ultrasound or moiré fringe methods. In addition, electromagnetic imaging techniques may be employed. Thus, the present invention is not limited to the use of video or X-ray methods, but encompasses other three-dimensional scanning technologies.

Carrier System Carrier system 124 is illustrated in FIGS. 3-8 as composed of a plurality of carrier assemblies/units/apparatus 126 spaced along the conveyance system 102. The carrier assemblies 126 are adapted to carry and move cutter systems 120 relative to the conveyance system 102.

The carrier assemblies 126 in basic form include a gantry 170 extending across the conveyance system 102 for supporting and guiding a carriage 172 for movement transversely to the direction of movement of the conveyor belt. The carriage 172 is powered by a drive system including, in part, the motive system 174 and an associated drive train 176. A second, longitudinal support structure or beam 178 is cantilevered outwardly from the carriage 172 in a direction generally aligned with the direction of movement of the conveyor belt 160. A second longitudinal carriage 180 is adapted to move along the beam structure 178 by a drive system which in part includes the motive system 174, to power the longitudinal carriage 180 through the use of the drive train 176. A cutter assembly 122 is mounted on the carriage 180 to move longitudinally of, or relative to, the conveyor belt 160, as the cutter assembly operates on the underlying work products 104 being carried by the conveyance system.

The gantry 170 is composed of a support structure 190 that spans transversely across the conveyor belt 160 at an elevation spaced above the belt. The support structure 190 can be composed of a hollow, rectangular construction, but may be formed in other manners and shapes without departing from the spirit or scope of the present invention. The ends of support structure 190 are supported by elongated upright brackets 192 and 194. As shown in FIG. 4, bracket 192 is fixed to the adjacent ends of the support structure 190 to extend downwardly for mounting relative to conveyor system 102. A plurality of hardware members 196 extend through clearance holes (not shown) formed in the lower, offset portion of bracket 192 to attach the bracket to the conveyor system or to a frame structure for the conveyor system. A bracket 194 extends downwardly from the opposite end of the support structure for attachment relative to the conveyor system or frame thereof. In this regard, hardware members 198 extend through clearance holes provided in the lower end of bracket 194 to attach the bracket to the conveyor or frame. In this manner, the support structure 190 is mounted securely and stationarily relative to the conveyor system or the frame therefor.

Figure 7:
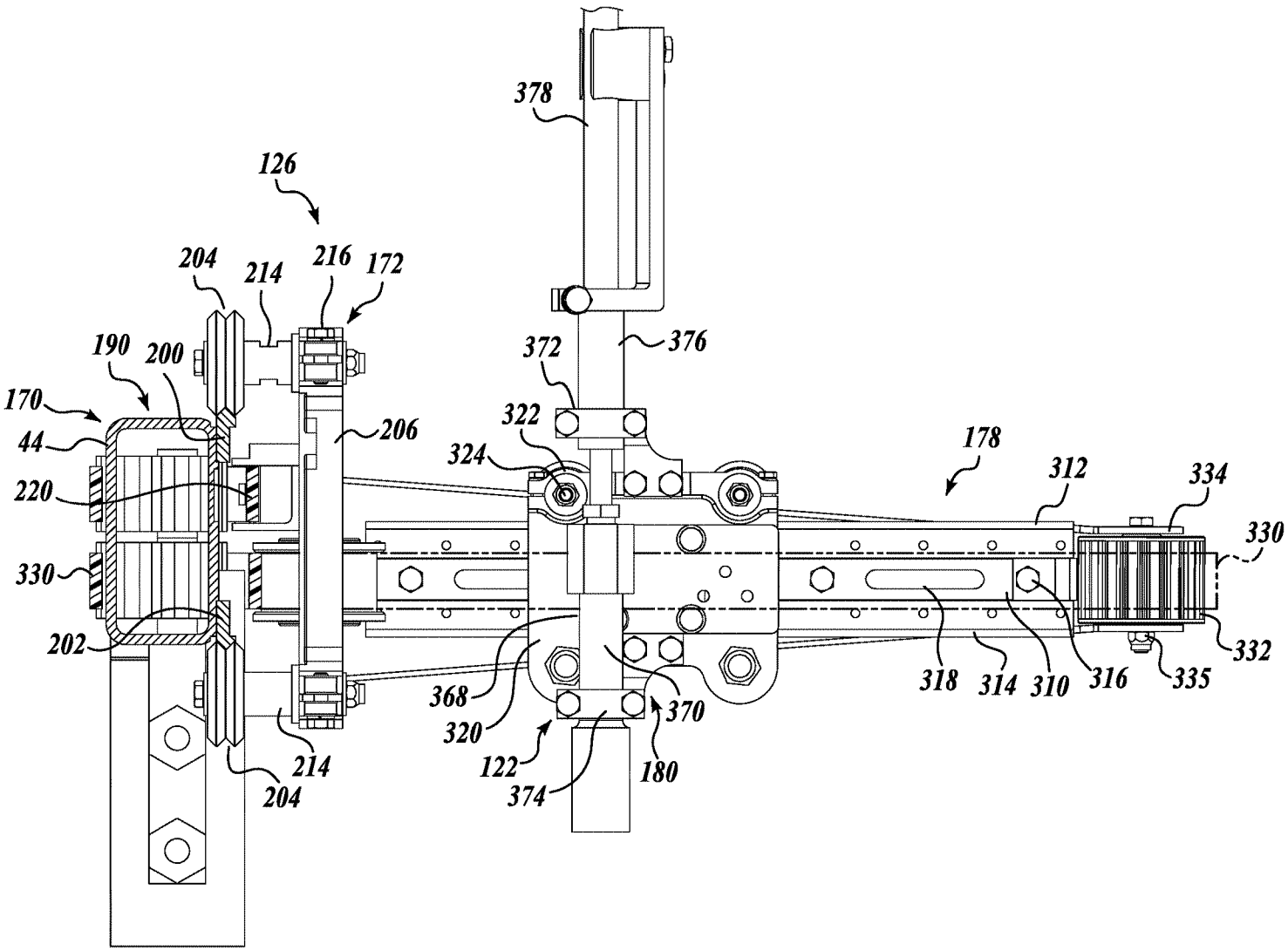
FIG. 7 is an elevational view of a portion of FIG. 4 partially in cross-section.

Gantry 170 also includes a track for guiding transverse carriage 172 along support structure 190, composed of an upper rail 200 and the lower rail 202 attached to the face of the support structure facing the carriage. As illustrated in FIG. 7, the upper rail 200 extends along the upper corner of the support structure, whereas the lower rail 202 extends along the lower corner of the support structure. As also illustrated, the upper surface of the upper rail and the lower surface of the lower rail are crowned to engage with the concave outer perimeters of rollers 204 of carriage 172. As such, the carriage 172 is held captive on the track while traveling back and forth along the support structure.

As illustrated in FIGS. 4-7, carriage 172 includes a substantially planar, generally rectangularly shaped bed portion 206 having a reinforced outer perimeter for enhanced structure integrity. The carriage rollers 204 are attached to the corners of the bed 206 by stub axles 214 which engage within through-bores formed in bosses 216 which extend transversely from each of the four corners of the carriage bed 206. Antifriction bearings (not shown) are utilized between the rollers 204 and the stub axles 214 to enhance the free rolling of carriage 172 along support structure 190.

Carriage 172 is powered to move back and forth along support structure 190 by motive system 174. In this regard, a timing belt 220 extends around a driven pulley 222 located at the lower end of drive shaft assembly 223 of motive system 174 and also around an idler pulley 224 of an idler assembly 226 mounted on the upper end of bracket 192 by upper and lower bracket ears 228 and 230. As such, the belt 220 makes a loop around the support structure 190, extending closely along the sidewalls of the structure. The idler pulley 224 is adapted to rotate freely about central shaft 232 of the idler assembly 226 through the use of an antifriction bearing (not shown) with the upper and lower ends of the shaft being retained by bracket ears 228 and 230.

The belt 220 is connected to the backside of carriage bed 206. As most clearly shown in FIG. 6, a spring-loaded clamping structure 240 connects the belt 220 to the carriage bed 206 so that if the carriage becomes jammed or locked along the support structure, if the carriage 172 is ever in a "runaway" condition or if motive system 174 malfunctions tending to cause the carriage to overrun support structure 190, the belt 220 can slide or move relative to the carriage 172. As such, potential damage to cutter apparatus 122 may be avoided or at least minimized.

The clamping structure 240 includes a base or back block 242 mounted to the back face of the carriage bed 206. A face plate 244, mounted to the back block 242, is resiliently clamped against the toothed surface of belt 220. The surface of face plate 224 interfacing with the belt 220 is ridged to match the contours of the belt 220. Normally the clamping force that clamps the face plate 244 to the block 242 securely clamps the belt 220 to the clamping structure. However, if the tension in the belt 220 extends a certain level, then the belt 220 is able to slip relative to the clamping structure.

Referring to FIG. 4, the motive system 174 includes a servo motor 260 programmable to control the movement of the carriage 172 back and forth along support structure 190 as desired. The servo motor 260 is positioned at a location substantially insulated from moisture or other contaminants that may be associated with the work/processing being carried out on the work products 104. A hollow drive shaft (not shown) extends down through drive shaft assembly 223. The driven pulley 222 is attached to the lower end of the hollow drive shaft and a drive pulley 262 is attached to the upper end of the hollow drive shaft. The drive pulley 262 is connected by belt 264 to an output drive pulley (not visible) powered by servo motor 260. It will be appreciated that by the foregoing construction, the servo motor 260 is located remotely from the carriage 172, with the driving force applied to the carriage 172 by the lightweight timing belt 220. An encoder, not shown, may be associated with servo motor 260 or other components of the related drive train 176 to enable the location of the carriage 172, and thus the cutter assembly 122 carried by the carriage 172, to be known to the system 100 and processor 150.

By the foregoing construction, motive system 174 is capable of quickly accelerating and decelerating carriage 172 for movement along support structure 190. Although ideally motive system 174 utilizes a servo motor, other types of electrical, hydraulic, or air motors may be employed without departing from the spirit or scope of the present invention. Such motors are standard articles of commerce.

Next, referring specifically to FIGS. 4-8, the longitudinal support structure or beam 178 cantilevers transversely from carriage 172 to be carried by the carriage. The beam 178 is composed of a vertical sidewall 290 which is substantially perpendicular to the adjacent face of carriage bed 206. The opposite sidewall 292, rather than being substantially perpendicular to the carriage bed 206, tapers towards sidewall 290 in the direction away from the carriage bed 206. Likewise, the top and/or bottom walls 294 and 296 of beam 178 taper toward the free end of the beam, thereby to cooperatively form a generally tapered shape. As will be appreciated, this enhances the structural integrity of the beam while reducing its weight relative to a parallel-piped structure.

Figure 8:
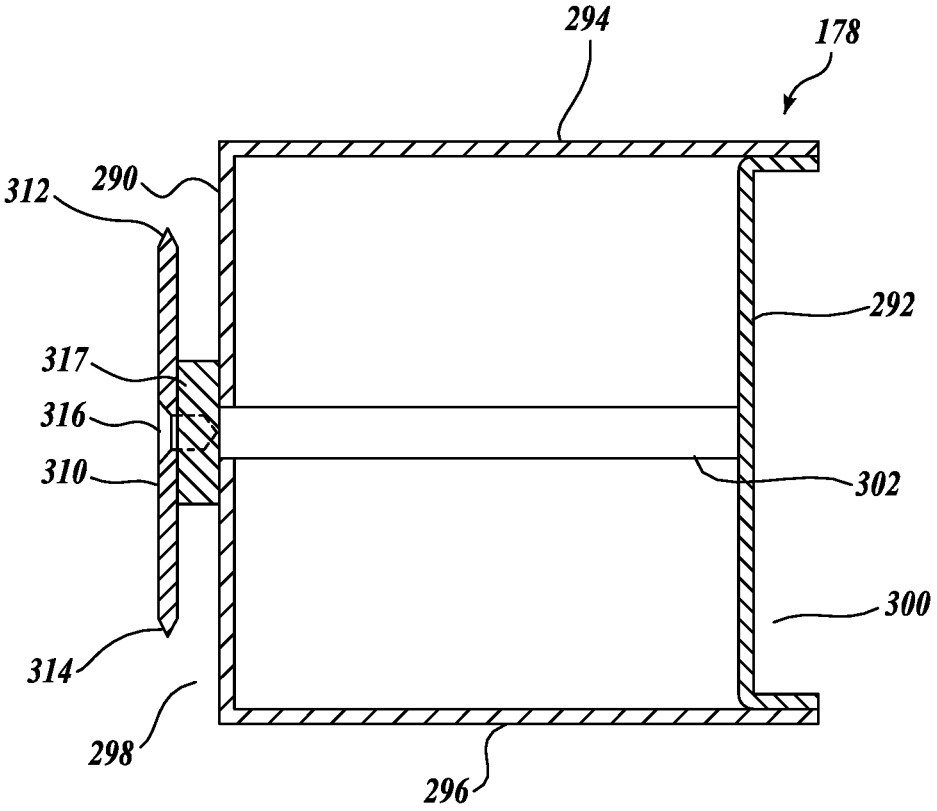
FIG. 8 is a cross-sectional view of FIG. 5.

As illustrated in FIG. 8, in one form the beam 178 may be of hollow construction, composed of two channel-shaped members 298 and 300. Channel member 300 is shallower than channel member 298 and nests within channel-shaped member 298 so that the flanges of channel member 300 overlap the free end edges of the flanges of channel-shaped member 298, as shown in FIG. 8. A plurality of spacers 302 are disposed within the beam member 178 and located along its length to bear against the sidewalls 290 and 292 of the channel members 298 and 300. The flanges of the two channel members are attached together and the spacers 302 are attached to the channel members by any convenient means, including by weldments. It will be appreciated that by the foregoing construction, beam 178 is not only lightweight, but also of sufficient structural integrity to carry significant weight without deflection. Beam 178 may be secured to the carriage bed 206 by any appropriate technique, including by hardware fasteners, weldments, etc.

Figure 5:
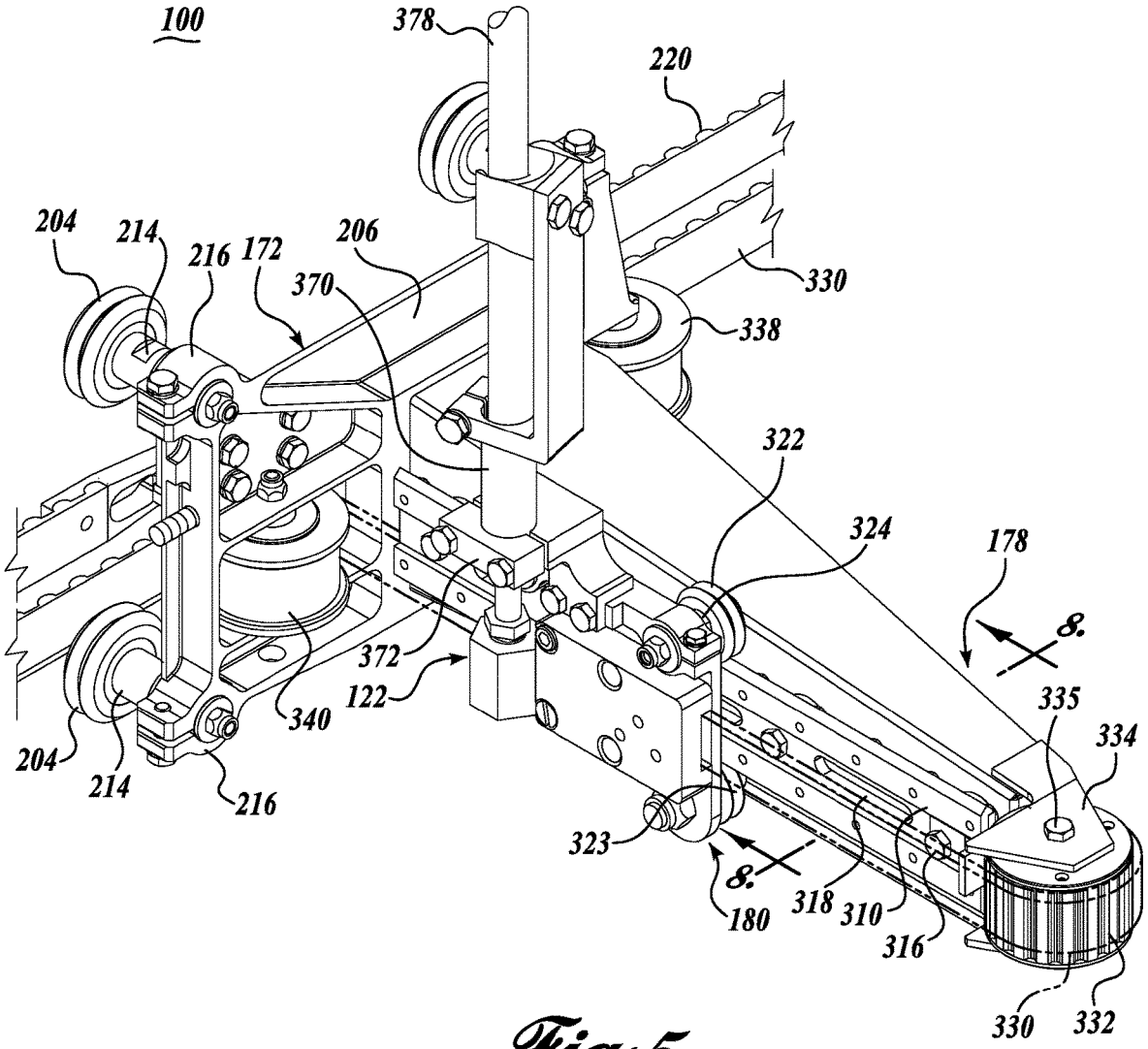
FIG. 5 is an enlarged fragmentary view of FIG. 4.
Figure 6:
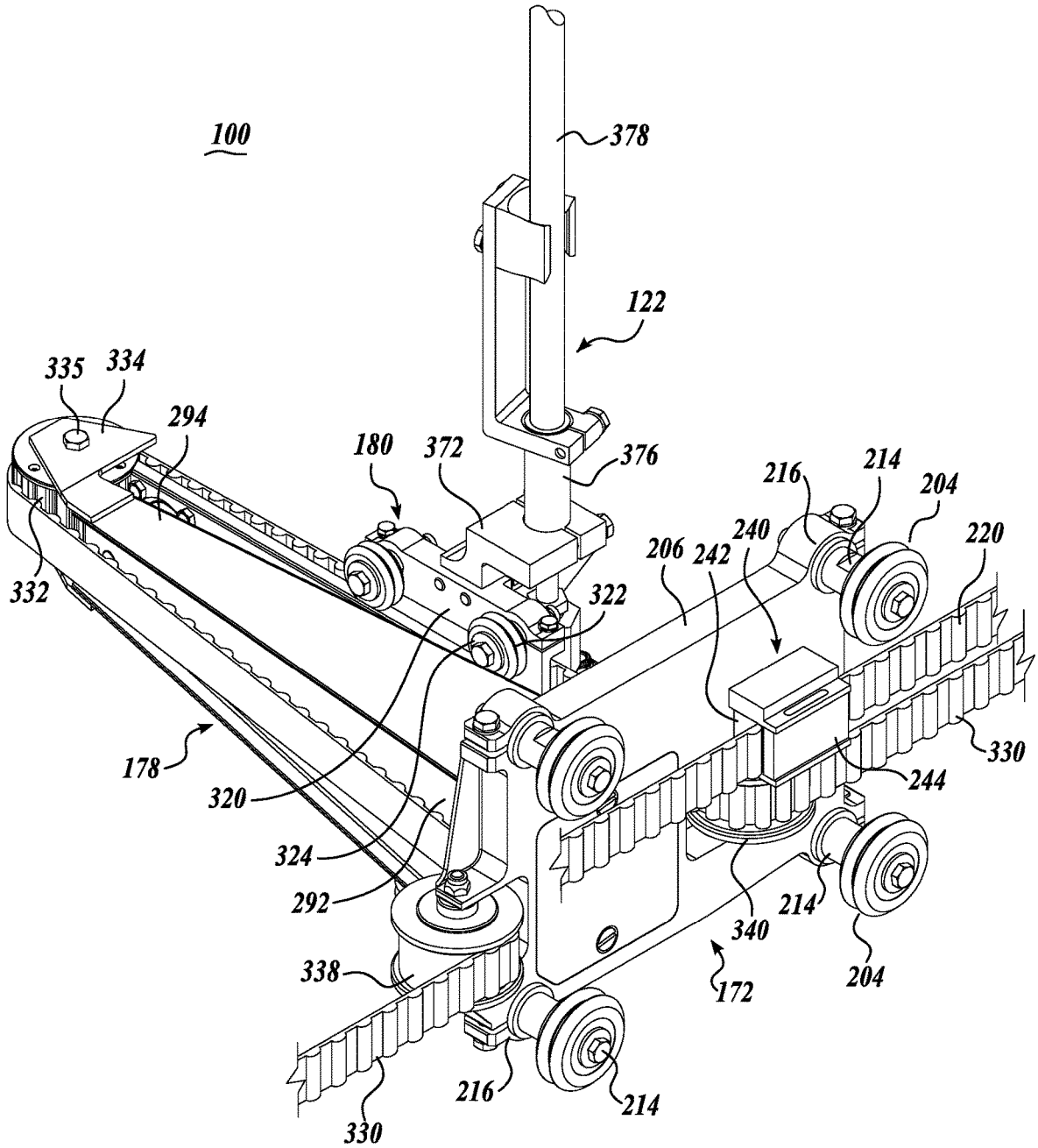
FIG. 6 is an enlarged fragmentary view taken from the back side of FIG. 5.

Referring to FIGS. 5, 7, and 8, an elongate track 310 for carriage 180 is mounted on and extends longitudinally on beam sidewall 290. Track 310 includes formed upper and lower edge portions 312 and 314 that are spaced away from sidewall 290 to define upper and lower rails for guiding the longitudinal carriage 180. The track 310 is attached to beam sidewall 290 by a plurality of hardware members 316 and extends through clearance holes formed in the track and through spacers 317 fixedly mounted to sidewall 290 at the back side of the track to engage the beam 178. Also to minimize the weight of track 310, cut-out oval openings 318 are formed in the track.

The longitudinal carriage 180 is adapted to travel along track 310. In this regard, the carriage 180 includes a substantially planar, rectangularly shaped bed portion 320 and a pair of upper rollers 322 and a pair of comparable lower rollers 323 having concave outer perimeter portions sized to closely engage with the correspondingly crowned track upper and lower rail edge portions 312 and 314. The upper and lower rollers 322, 323 are mounted on stub shafts 324 extending transversely from the carriage bed 320. Ideally, but not shown, anti-friction bearings are utilized between the stub shafts 324 and the rollers to enhance the free movement of the carriage 180 along track 310.

Carriage 180 is moved back and forth along track 310 by the motive system 174 that powers a timing belt 330. To this end, an idler pulley 332 is mounted on the distal free end of support beam structure 178 by a formed bracket 334 which is fixedly attached to the beam structure 178. A pivot shaft 335 extends through the center of an antifriction bearing (not shown) mounted within pulley 322, with the ends of the shaft retained by the upper and lower ears of bracket 334.

The ends of belt 330 are attached to the bed 320 of carriage 180. This attachment can be carried out in a number of ways, including the use of a system that is similar to that described above regarding the attachment of belt 220 to carriage 172 described above. Also, the belt 330 extends partially around directional pulleys 338 and 340, anti-frictionally mounted on carriage bed 206 to direct the belt along support structure 190 and along longitudinal support structure 178.

Rotation of a drive pulley 350 carried by the lower end of drive shaft assembly 223 results in movement of the belt 330 which in turn causes the carriage 180 to move along track 310. In this regard, the motive system 174 includes a servo motor 360 which is drivingly connected with drive pulley 350 by a drive shaft 362 that extends downwardly through drive shaft assembly 223. A driven pulley 364 is attached to the upper end of drive shaft 362, which pulley is connected via timing belt 366 to a drive pulley (not visible) powered by motor 360. The drive shaft 362 is disposed within the hollow drive shaft D extending between pulleys 222 and 262. An encoder, not shown, may be associated with the servo motor 360 or other components of the related drive train 174, to enable the location of the carriage 180, and thus the cutter assembly 122 carried by the carriage 180, to be known to the system 100 and processor 150.

As with motor 260, other types of well-known and commercially available rotational actuators may be utilized in place of servo motor 360. Also, as noted above, motive system 170 is located remotely from not only transverse carriage 172, but also longitudinal carriage 180. As a result, the mass of the motive system 174 is not carried by either of the two carriages; rather the motive system is positioned at a stationary location, with the drive force being transferred from motive system 174 to carriage 180 by a lightweight timing belt 330. As a consequence, the total mass of the moving portions of carrier system 124 (carriage 172, support beam 178 and carriage 180) is kept to a minimum. This allows extremely high speed and accurate movement of the two carriages, with accelerations exceeding eight gravities.

Cutting System

A work tool in the form of a cutter apparatus 122 depicted as in the form of a high pressure liquid nozzle assembly 368 is mounted on the longitudinal carriage 180 to move therewith. The nozzle assembly emits a very focused stream of high pressure water disposed in a downward cutting line that is nominally transverse to the plane of conveyor belt 160. The nozzle assembly 368 includes a body portion 370 that is secured to the carriage bed 320 by a pair of vertically spaced-apart brackets 372 and 374. The nozzle assembly includes a lower outlet directed downwardly toward conveyor belt 160. A fitting 376 is attached to the upper end of nozzle body 370 for connecting the nozzle body 370 to a high pressure fluid inlet line 378. High pressure liquid nozzles of the type embodied by work tool 122 are well-known articles of commerce.

Calibration System/Procedure

As noted above, for accurate portioning or trimming to take place utilizing the cutting apparatus or unit 122, it is necessary to calibrate the portioning system 100. In this regard, there needs to be correspondence between what is viewed by the scanning system 110 and the location and/or movement of the cutter units 122 so that the work products 104 are accurately portioned into desirable sizes or weights and/or fat or other undesirable components are accurately trimmed from the food products or bones or other foreign or undesirable materials are accurately excised from the food products. In this regard, it is necessary to calibrate the cutting units 122 in both the lateral or cross-belt direction as well as in the longitudinal or down-belt direction of travel. Moreover, it is necessary for such calibration of the cutter units to be carried out as quickly as possible, but also accurately.

Figure 11:
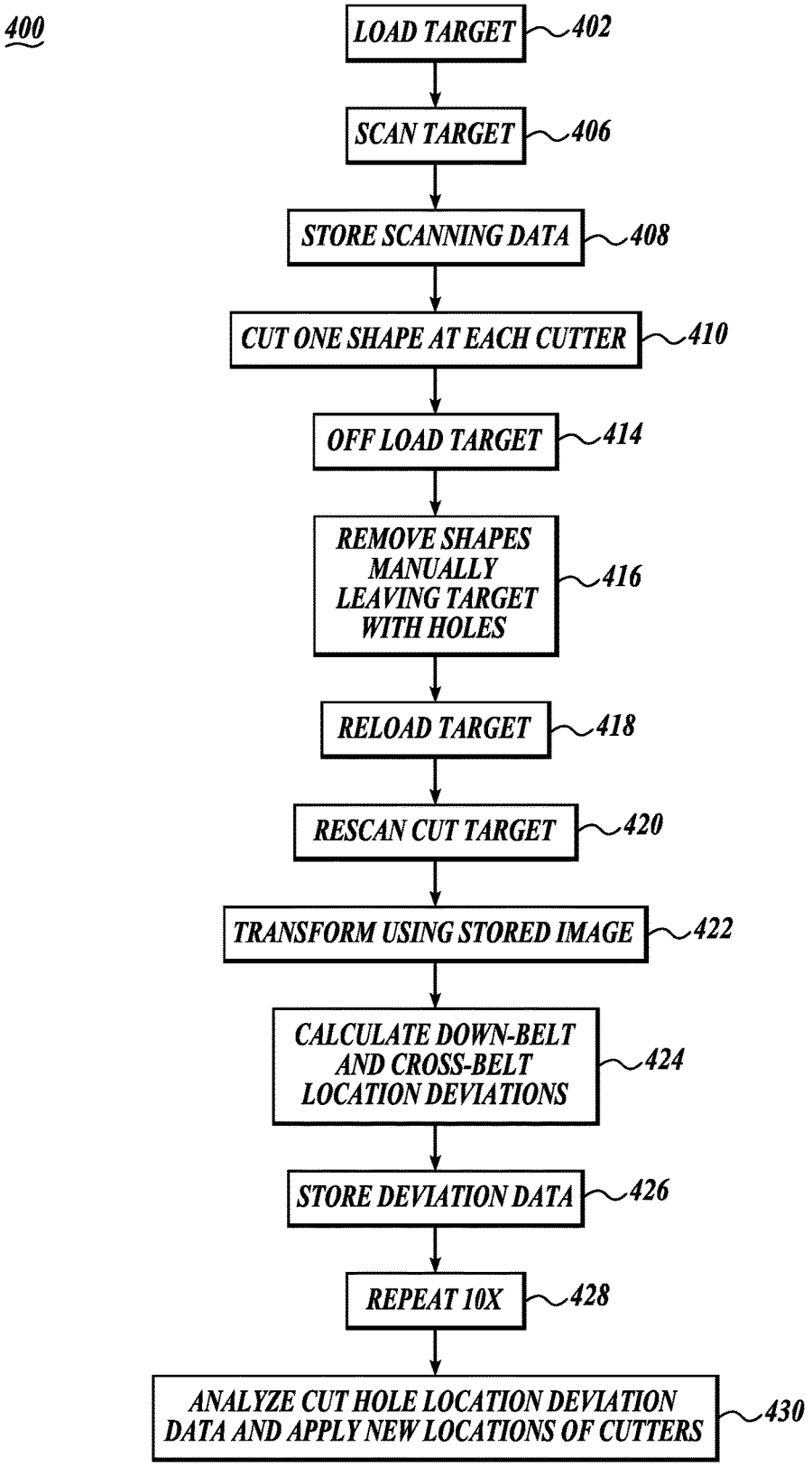
FIG. 11 is a flow diagram of one calibration method of the present disclosure.

FIG. 11 schematically depicts one methodology 400 for rapidly but accurately calibrating portioning system 100. The method 400 begins at step 402, wherein a specialized target 404 is loaded onto the conveyor 102 in an orientation relatively aligned with the longitudinal direction of travel of the belt 160, i.e., "down-belt" direction. The target 404 is carried by the conveyor 102 past scanning station 110, wherein the target 404 is scanned at step 406. At the scanning station, data pertaining to physical attributes of the target 404 are ascertained, e.g., the shape and size of the target including its length, width, outer contour, etc. Also, data with respect to the centroid of the target is captured, as well as the location and orientation of the target with respect to the conveyor 102. This information is stored by processor 150 at step 408.

Figure 12:
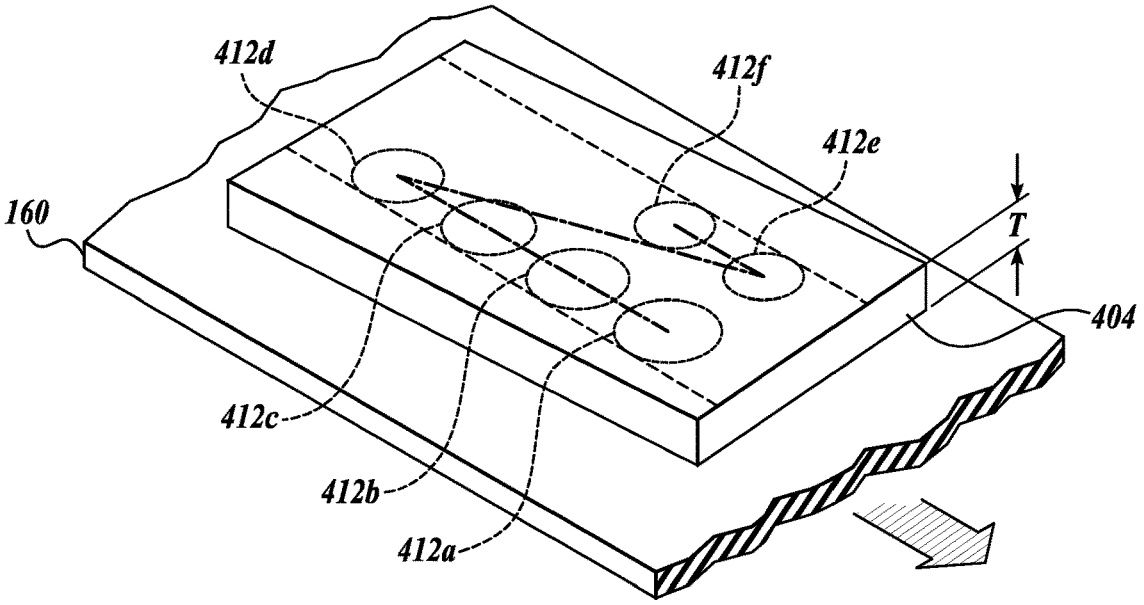
FIG. 12 is a schematic view of a calibrating target of the present disclosure.
Figure 13:
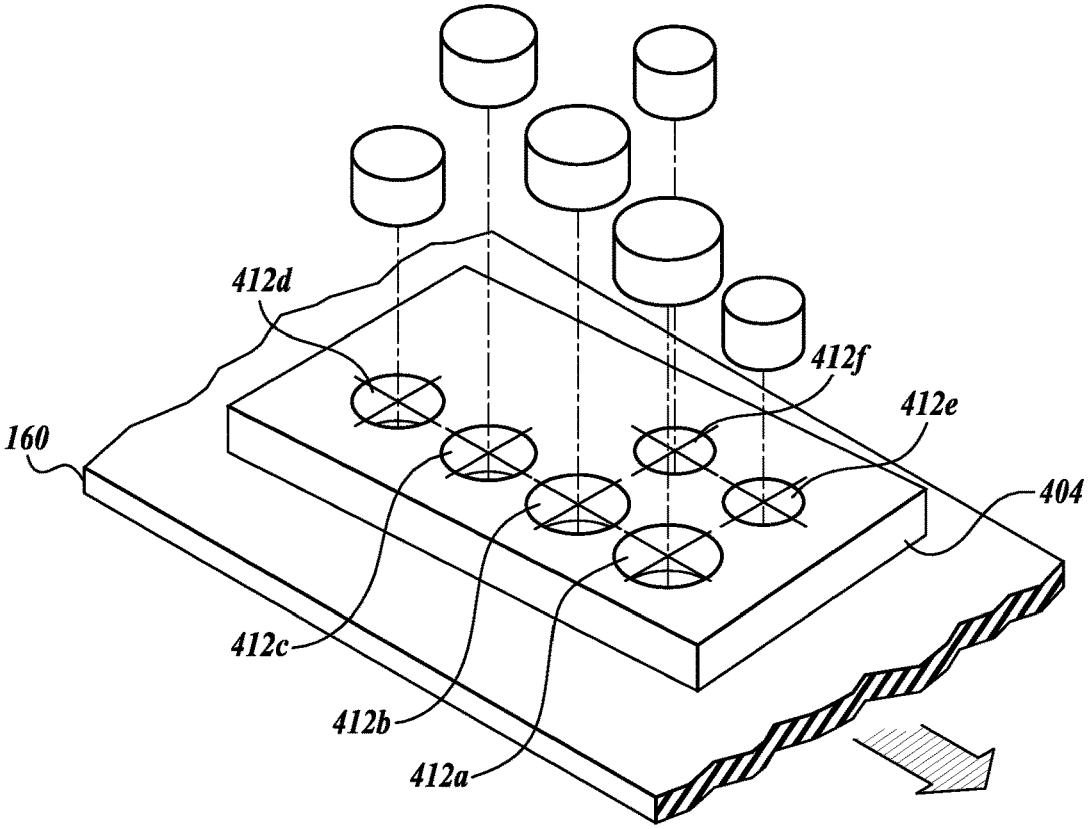
FIG. 13 is a view similar to FIG. 12 showing calibrating holes cut in the target by the cutters of the system shown in FIG. 3.
Figure 14A:
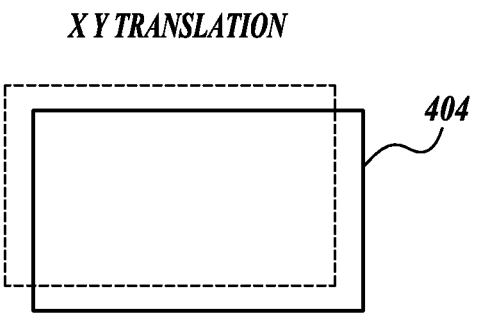
FIGS. 14A-14F schematically illustrate the manner in which calibrating targets may move or distort during the calibration process.
Figure 14B:
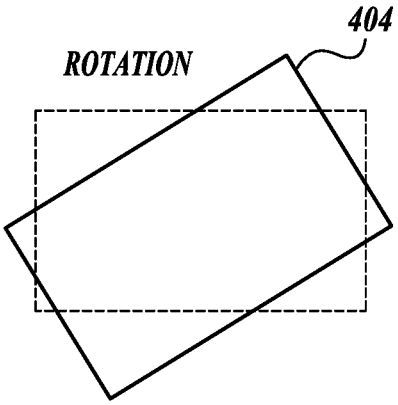
Figure 14C:
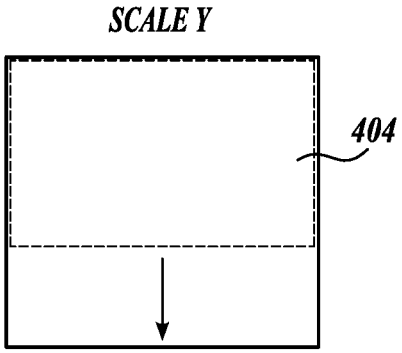
Figure 14D:
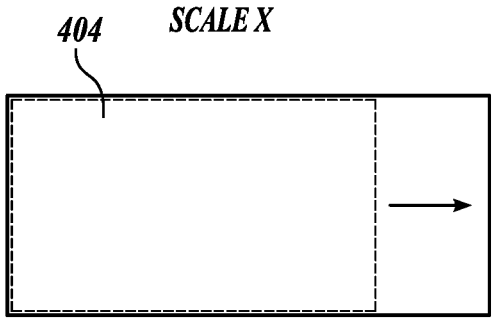
Figure 14E:
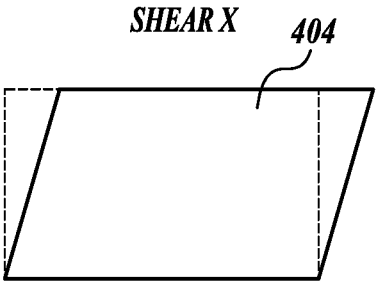
Figure 14F:
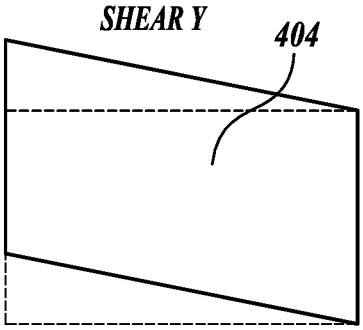

Thereafter, at step 410, each of the cutting units 122 cuts a pattern or shape in the target 402 at a specified location on the target and of a specified size as preprogrammed by processor 150. FIGS. 12 and 13 show one example of the cut shape in the form of circular holes 412.

Next, the cut targets are removed from the conveyor at step 414, and then the cut portions or shapes are removed from the holes 412 at step 416. Thereafter, the targets 404, with the cut shapes removed, are reloaded onto the conveyor 102 at step 418, and again the targets are aligned in relatively the down-belt direction. Next, the reloaded targets 404 are rescanned at step 420. At this point, the system 100 is capable of determining if the target is now at a different orientation than when originally scanned, and if so, a transformation process is carried out at step 422 so that the target 404 is virtually reoriented to its location relative to the conveyor 102 when the target was originally scanned. Thereupon, the scanner 110 is able to ascertain or measure the location and size of each of the holes 112 cut in the target 404 as well as the location of each of the holes relative to each other.

Then, at step 424, the system 100 ascertains whether the location of the holes 412 is at the expected location on the target in directions transverse to the conveyor 102 as well as longitudinally relative to the conveyor. This comparison is made based on comparing the centroids of holes 412 or other shapes/patterns cut in the targets. The deviations of the holes from the expected locations represent the deviations of the cutter units 122 from their expected locations relative to datums associated with the scanner. These deviations from the expected locations are stored in memory 158 at step 426.

As represented by step 428, the foregoing procedure is repeated for a total of ten times, thereby to accumulate sufficient data to determine the tolerance of the measured location of each of the cutting units 122 as well as the standard deviation in the measured locations of the cutters. The processor 150 averages all of the positional deviations of the cutters and calculates a corrected location or position which is applied to each cutter as needed. The mean measured locations of the cutters provide the data to adjust or correct the location of each cutter.

The tolerance of the measured positions of the cutters is calculated to provide some measure of the degree of confidence in the dataset. The statistics of the calculated results can be updated in real time after each test, but the actual update of the cutter location may not be implemented until commanded by the operator. This allows the operator to have more control over the number of tests being run, by limiting the number of tests, either because the machine system 100 is already very well calibrated and unlikely to change in value with more tests, or because the system has an obvious mechanical issue that will not likely be corrected by further calibration.

The standard deviation of the differences of cutter position provides an indication of the variation of cutter locations inherent in the system 100. As an example, a high standard deviation may indicate that the belt 160 is stretched, kinked, or otherwise damaged or worn, or that the cutter drive mechanism is misaligned, worn or damaged. A limit may be set on the standard deviation value that indicates a failure of calibration, indicating some mechanical correction is needed to the system.

At step 430, the data from all ten targets is analyzed, and if the location of one or more of the holes is found to offset in the lateral direction from the expected location, then the system 100 is able to "reset" the location of the applicable cutter 122 in the lateral direction. If needed, this same process can occur in the longitudinal direction relative to the conveyor 102. If the "down-belt" location of one or more of the holes 412 is not at the location expected, then the location of the cutting apparatus 122 is "adjusted" to reflect the actual location of the cutter relative to a datum associated with the scanner. In practical terms, what occurs during a "reset" of the cutter location is that the nominal or "zero point" location of each of the cutters relative to a datum location with respect to the scanner or other location relative to system 100 is adjusted. An example of a "zero point" location for the cutters 122 is set forth below.

Some of the steps and other aspects of the foregoing procedure are discussed below in more detail.

Targets

The targets 404 are shown in FIGS. 12 and 13 as generally rectangular in shape with a thickness "T." The targets 404 can be of many selected shapes and sizes depending on various factors, for example, the number of cuts to be made in the target and the size of the cuts to be made in the target. Preferably, the targets are composed of materials that can be easily viewed by the types of cameras and lasers typically employed as components of high speed portioning machines. Also, since cuts or cutouts are to be made in the targets, it is desirable that the composition of the target be such that it can be easily cut by waterjets or other types of cutters employed. Moreover, the target material should be such that the targets are securely gripped by the conveyor belt 106 so as not to move or slip while being cut.

Further, it would be advantageous if the targets are composed of food grade material, are of non-toxic composition and are compatible for use with portioning machines that undergo full sanitation procedures following calibration. In this regard, suitable target materials may include memory foam composed of open-celled polyurethane or similar material. Such foam material meets the foregoing requirements and also is inexpensive and recyclable. Thus, targets composed of memory foam can be recycled after use.

Other suitable materials for the targets include foamed thermoplastics, foamed rubber, foamed synthetic rubber, polylactic acid, other organic food-based materials, rubber, synthetic rubber, paper, cardboard and corrugated cardboard, or similar materials.

It is desirable that the targets 404 have a certain thickness so that the holes or other shapes cut in the target have three-dimensional configuration that can be easily and accurately detected by the scanner 110 when the cut target is rescanned to characterize each of the cut holes or other cut shapes as well as the spatial relationship between the cut holes or other shapes.

Loading of Targets

Targets 404 may be loaded on the conveyor belt 160 to space the targets along the length of the belt so that the targets extend along one entire belt length. In this manner, the calibration system and method 400 in the present disclosure may be able to detect whether the belt 160 is stretched, kinked, or otherwise damaged at a particular location along its length. This could be indicated by the ascertained cross-belt location of cutting units 122 being significantly different at a specific belt location, than at the locations on the belt of the other nine targets utilized. A similar anomaly might occur as to the down-belt locations of the cutters 122 for a particular target 404 relative to the other nine targets being utilized.

It would be appreciated that if the targets 404 are identical in size and shape but are placed on the belt 160 at variable angles, but the holes or other shapes are cut in the targets in a parallel, down-belt direction, then it will be necessary to be able to identify each of the targets when rescanned. This can be carried out by numerous methodologies. For example, each of the targets could be prenumbered and then the scanner 110 simply reads the number of the target. Such number could be applied by the machine operators at a standard location on the targets. As an alternative, each target could have a unique serial number when manufactured, with the serial number being readable by the scanner 110. Other alternatives include using bar codes whether standard 1D bar codes, 2D bar codes or 3D bar codes, or QR codes. Further, RFID tags would be employed.

In addition, as discussed more fully below, the system 100 can be programmed to recognize each target by the positioning of the holes or other cut patterns relative to the perimeter or other feature of the target. This information is ascertained during the initial scanning and cutting of the target. When the target is rescanned, the system is able to recognize the unique relationship between the pattern of the holes or other cuts made in the target and the outer perimeter or other shape parameter of the target.

As also discussed more fully below, the system 100 is able to carry out a transformation between the position of the target when initially scanned and the subsequent position of the target when rescanned. The system is able to characterize each of the holes of the transformed target and the spatial relationships between such holes or other cutouts made in the target. Thus, it is not required that the targets be reloaded onto the conveyor in the same order as initially loaded onto the conveyor and the targets need not be repositioned very closely to the original position or angular orientation of the target relative to the conveyor belt when reloaded onto the conveyor.

Initial Scanning

When the scanner 110 first scans a target 404, prior to cutting the holes or other shapes in the target, the scanner must be able to clearly view the overall outline of the target. With this information, the system 100 is capable of establishing the orientation of the target, for example, relative to the longitudinal direction of the conveyor, and also is able to determine the overall dimensions of the target. Moreover, the location of the target on the conveyor 160 is known with a high degree of precision. The location of the target, as discussed above, is tracked as the target travels on the conveyor by the belt drive encoder 162. The location of the target is tracked until at least the time that the target reaches the cutting units 122.

Cutting of Target

As shown in FIGS. 12 and 13, shapes in the form of circular holes 412*a*-412*f* are cut in the target 404 with each hole cut by one of the cutting units 122. Preferably, the same cut shape location and size is made by a specific cutting unit 122 for each of the multiple targets being cut during the calibration process. The shape and size of the cuts made do not have to be the same for each of the cutting units, but can be if desired. This will allow both the cross-belt location and down-belt location of each of the cutting units 122 to be calibrated using a singular hole or other type or shape of cutout.

Alternatively, separate targets can be used to calibrate the cross-belt location of the cutting units versus the down-belt location of the cutting units. In this situation, as one example, the cutting units 122 can be programmed to cut narrow slits in the target 404 thereby to establish the locations of the cutting units relative to a cross-belt datum associated with the scanning unit and relative to a down-belt datum associated, for example, with the scanning unit. The slits make it clear whether the cross-belt or down-belt locations of the cutting units are being calibrated.

As noted above, in the present calibration procedure, the particular hole (or other shape) cut in the target by a specific cutting unit 122 must be identified. One methodology of doing so is to program each cutter to cut a different size hole, thereby enabling convenient and precise identification of which cutter cut which hole. Nonetheless, it is also possible that all of the holes cut by the cutter are of the same size, in which case other techniques would be required to identify which cutter cut a particular hole in the target.

As an alternative, one or more of the cutters 122 can be programmed to cut one or more additional holes per target. Such additional holes can act as fudicials to clearly identify the orientation of the target relative to the belt when the target was initially cut since the holes from the same cutter will be in downstream alignment.

As a further alternative, one or more cutters can be programmed to cut one or more additional holes per target that can be used to identify the target in the sequence that the targets were cut. For example, in the first target, the first cutter could be programmed to make two cuts. Thereafter, in the second target, a second cutter could be used to make two cuts, and so on. In this manner, the sequence in which the targets were cut is readily ascertainable.

Although FIGS. 12 and 13 illustrate the cuts made in the targets 404 as circular holes 412*a*-412*f*, other shapes may be cut in the target, such as a square, a triangle, a star, etc. The only requirement is that the shaped cut has measureable and predictable dimensions so as to provide an easily ascertainable centroid for the shape cut.

Second Scan

As noted above, after the cutting of the targets 404 occurs, the targets are removed from the belt 160 and the cut pieces are removed from the targets leaving circular holes 412*a*-412*f*. The targets 404 are then scanned again so that the scanner 110 can characterize each hole 412*a*-412*f* and the spatial relationship among/between the holes.

The processor 150 receives the first and second data sets from the first and second scanning steps and compares the second data set with the ostensible corresponding first data set from the patterns cut from the target. This comparison is to verify that the cut target 404 rescanned by the optical scanner corresponds to the same cut target 404 previously scanned by the scanner.

As noted above, if in comparing the first and second data sets, a sufficient variation exists between such data sets pertaining to the size/shape parameters of the target, then translation of the first data set onto the second data set can be carried out. This translation can include one or more of the directional translation of the target, the rotational translation of the target, the scaling of the size of the target, or the shear distortion of the target. Such translations are illustrated in FIGS. 14A-14F as discussed more fully below.

The physical parameters of the targets being compared by the scanner may correspond to the outer perimeter configuration of the target. In this regard, the first and second data sets may pertain to locations along the outer perimeter of the target. More specifically, the first and second data sets may correspond to coordinates corresponding to locations along the outer perimeter of the targets. However, other physical parameters of the targets may be ascertained during the scanning processes. Such parameters may include various size and shape parameters, and more specifically, the target length, target width, aspect ratio, thickness, thickness profile, contour, outer contour, outer perimeter size, and/or outer perimeter shape.

It may be that the processor 150 determines that the target being rescanned is not the same target as the expected previously scanned target. Thereupon the processor determines if a next rescanned target is the same target as originally scanned by the optical scanner. In this situation, there is no data set corresponding to the data set from the rescanning because the target in question was not reloaded onto the conveyor, or reloaded in a different order. As such, the processor will look to the next data set from the original scanning to determine if the corresponding target matches the data set of the target in question. If one target was not replaced, then the next data set from the on-grid scan should match the data of the rescanned target in question. Thereafter, the system 100 proceeds to the next target arriving at the optical scanner for rescanning and will subsequently search for the original scanning data for that target. If the targets were simply reloaded on the conveyor out of order, but all are present, then the processor 150 can simply cycle through all of the data from the original scanning to locate the correct target 404.

The comparison of the first and second data sets by the processor can be carried out using various analysis methodologies. One such methodology is the Root Mean Square error analysis wherein the values of the first and second data sets can be compared. A second analysis methodology that may be utilized is the standard deviation of the data values of the first and second data sets. A threshold or benchmark standard deviation may be preset so that deviations below the set value will indicate that the data from the first and second data sets are sufficiently similar that the corresponding target scanned by the scanner is the same. A third analysis methodology that might be utilized is a least squares regression analysis of the data values of the first and second data sets. Other analysis methodologies may be utilized.

Transformation

The results of the second optical scanning are transmitted to the processor. The processor analyzes the data from the stored first scan of the uncut target, first to confirm that the target that was re-scanned is the same as the target previously scanned or compared in memory. Once this identity is confirmed, then if there has been any sufficient variation of orientation or relative position of the target during the rescanning step, or any significant distortion of the shape of the target, the applicable information or data from the initial scan is translated (also referred to as "transformed") by the processor onto the corresponding data generated by the second scan. Such translation may include one or more of: shifting of the target in the X and/or Y direction; rotation of the target; scaling of the size of the target; and shear distortion of the target, as more fully discussed below.

The optical scanner is capable of locating the target on the belt and thus ascertaining whether the target is shifted in the X and/or Y directions relative to the belt after transfer back onto the belt for the second scan. The scanner is also able to determine whether the target has rotated relative to the orientation of the target on the belt during the initial scan or whether the target has increased or decreased in length or width or otherwise distorted in shape relative to its configuration on the belt in the initial scan. (These later changes or distortions should not be an issue if the target 404 is of sufficient structural integrity.)

As noted above, the exterior configuration of the target is discernable by the scanner, which ascertains parameters related to the size and/or shape of the target (for example, length, width, aspect ratio, thickness, thickness profile, contour (both two dimensionally and three dimensionally), outer contour configuration; perimeter, outer perimeter configuration, outer perimeter size and/or shape, and/or weight, of the target). Some of these parameters only apply if the target is of three-dimensional shape.

With respect to the outer perimeter configuration of the target, the scanner can determine discrete locations along the outer perimeter of the target in terms of an X/Y coordinate system or other coordinate system. This latter information can be used by the processor to determine/verify that the target being scanned is the same target as expected. For example, the processor can compare the data identifying coordinates along the outer perimeter of the target as determined by scanning with the corresponding data obtained previously in the initial scan. If the data sets match within a fixed threshold level, then confirmation is provided that the target scanned is the same as the expected target.

Cut Shape Geometry

The software will determine a location on each shape that is cut in the target that is the locus of that particular shape. This could be the centroid of the shape, but the locus could be some other defined point, such as the furthest up-belt, down-belt, or cross-belt position of the shape.

The centroid (or other designated point of the cut shape) will be used to determine the location of the cutter when it cuts the shape in the target, in relation to a location of the scanner. Such location of the scanner can be the location of the laser line 116. The down-belt cutter location determined by the scanner can be compared to the expected location of the cutter relative to the laser line datum based on the values previously stored in the computer.

As an example, the distance from the centroid of the circle cut by a cutter from the most forward position of the target may be 24 mm, where the software instructed the cutter to cut the circle at a distance of 26 mm from the forward end of the target. It can then be determined that the actual location of the cutter is 2 mm from its expected location.

The information generated by scanning the cut targets is captured directly in the calibration software being used by the processor 150. Thus, there is no need for operators to physically input data generated by scanning of the target. Accordingly, by use of the presently disclosed methodology, it is possible that the entire cross-belt and down-belt calibration of the system 100 using light separate cutters 122 could be completed in as little as ten minutes by a minimally trained operator.

System Analysis

The ease and brevity of the disclosed calibration procedure may allow the calibration procedure to be used to characterize the operation of the system 100 much more completely than by using the pre-existing calibration technique discussed above in the "Background" section of the present application. As example, many more targets could be utilized to collect statistically significant data on the variation of both the down-belt and cross-belt calibration measurements, and data can be obtained at more locations on the belt. Rather than spacing ten targets equally along the length of the belt, the number of targets could be increased to 20 or even 30 targets along the belt in 5, 10, or more locations across the belt.

The diagnosis of electro-mechanical issues in high speed industrial food processing equipment can be critical to the economical operation of food processes. The present calibration procedure can provide information to enable the machine to be tuned to optimal down-belt and cross-belt calibration settings. Moreover, the present calibration methodology may also help pinpoint existing mechanical issues or problems with the system 100. As an example, data may indicate that a single cutter is cutting with a higher standard deviation relative to all other cutters, indicating some problem with that single cutter, which can be further diagnosed and corrected.

Alternative Methodology

Figure 18:
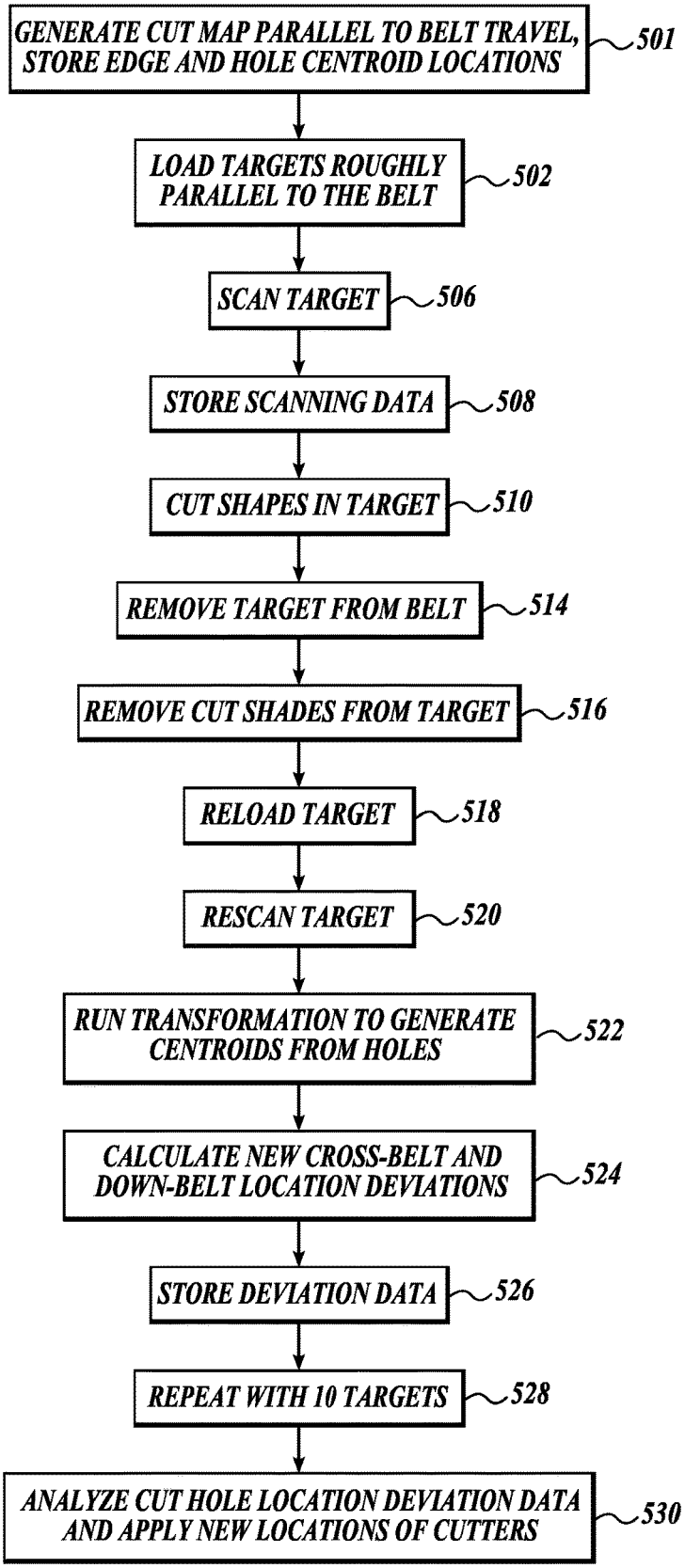
FIG. 18 is a flow diagram of a further calibrating procedure of the present disclosure.

An alternative methodology 500 of the present disclosure is shown in FIG. 18. In the illustrated alternative, in step 501, a virtual cut pattern is established wherein the target 404 is arranged parallel to the edge of the belt 160 and the holes 412 or other shapes are cut in the target of predetermined sizes with each size and/or shape identifying a specific cutter. Centroids of these holes or other shapes are parallel to the edge of the virtual target.

The actual targets are loaded in a substantially down-belt direction at step 502, but need not be oriented exactly down-belt. The targets are scanned at step 506 and the other steps of the process are carried out as shown in FIG. 18. These steps correspond to the steps shown in FIG. 11, but are identified by a 500 series number. Thus, the descriptions of those steps are not repeated for sake of brevity.

In the methodology 500, the system software determines the orientations of the targets 404 relative to the exact down-belt direction. With this information, the processor 150 forms transformations so that when the holes 412 are cut in the target 404, such holes are parallel to the edge of the target due to the transformation that has occurred. In other words, the software of processor 150 corrects for the angularity of the target 404 relative to the exact down-belt direction.

All ten targets 404 can be cut by spacing them representatively across and down the belt. After the cutting of the holes 412 or other shapes has occurred, as in the prior procedure 400, the targets 404 are removed from the conveyor 102 at step 514 and the cut portions are removed from the target per se at step 516. Thereafter, the targets are reloaded on the conveyor at step 518, again with representative spacing down and across the belt without regard to their order. These ten targets are all compared to a single saved image of what the cuts should be in all of the targets. This is possible because the holes 412 were all cut to be parallel to the edges of the target 404, and as such, each target 404 ideally should have been cut identically. Accordingly, there is no need to match the original scanned target to the same rescanned target. Instead, all of the rescanned targets should match the original cut virtual target. As such, each of the targets is compared with the virtual target. The information pertaining to the actual cross-belt and down-belt location of the individual cutters compared to their expected location can be utilized to adjust the locations of these cutters as known to the portioning system 100. Although this methodology may not be as accurate as other methodologies described herein, this method is quite straightforward and potentially easier and faster to implement than other methodologies.

Further Alternative Methodology

As a further alternative methodology, the holes 412 that are cut in the target 404 by the cutters 120 can be of different sizes and/or shapes per cutter 120 and per target 404. As such, the cutters 120 can be uniquely identified for each of the ten targets 404 by the system software, since in each target the shapes and/or sizes of the holes are unique. The system 100 is able to readily match the rescanning data with the original scanned data for each of the ten targets without having to keep the targets in the same sequence during the rescanning process.

The holes can be not only of different shapes and/or sizes, but also in different positions on the target, which also assists the software to recognize each unique target that has been rescanned and match that target with the correct scanning data from the original scanning of the target. Although not essential, the unique size and/or shaped holes cut in the target may be aligned either parallel to the target edge or parallel to the belt edge. As discussed above, to keep parallelism with the belt edge, the system performs a transformation based on the angularity between the edge of the target and the edge of the belt. As such, the holes can be all aligned parallel to the edge of the target even though the target is not disposed exactly parallel to the edge of the belt (not exactly in the down-belt direction).

Further, different combinations of the shapes and/or sizes of the holes formed in the target, or different combinations of different patterns of the shapes and/or sizes of the holes formed in the target, can be utilized, not only to identify each of the targets as well as each of the cutters, but also to monitor other aspects of the calibration procedure, including for example the lane or location in the cross-belt direction in which a shape was cut. These aspects of the cut target can be ascertained during the rescanning process to provide information used to not only calibrate the cutters 120, but also to analyze aspects, including operational parameters, of the portioning system. For example, as discussed above, the results of the foregoing calibration procedures can also indicate whether the conveyor belt may be damaged or whether a specific cutter may be out of alignment or otherwise requiring adjustment or service.

Datum

As discussed above, during calibration, the cross-belt location of the cutter is calibrated based on a datum associated with the scanner. Likewise, the down-belt location of the cutter is also based on a datum related to the scanner. Various datums can be utilized for this purpose.

Figure 9:
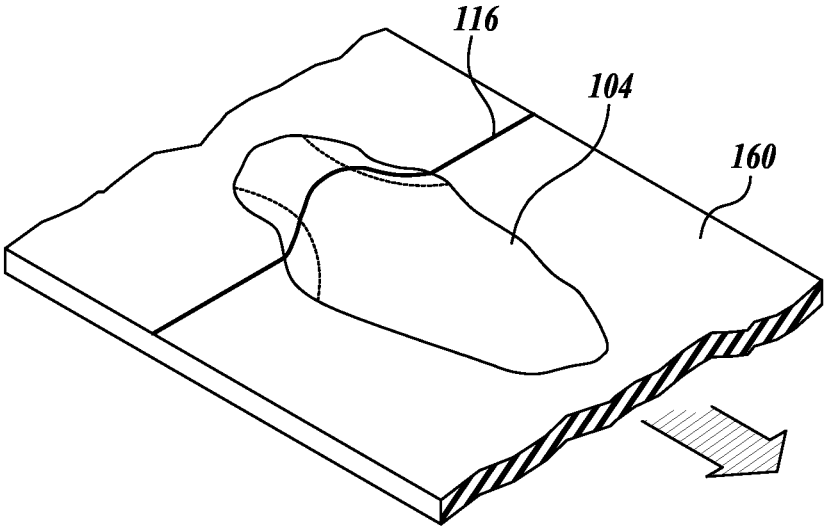
FIG. 9 is a schematic view of a light stripe or laser line applied to a workpiece during scanning.

One convenient datum for the down-belt location of the cutters is the location of the laser line or light stripe line 116, shown in FIG. 9. In this regard, see also FIG. 17, which schematically depicts the laser line 116 as well as the down-belt location of any illustrated cutter, represented by the distance "X". This distance is also referred to as the down-belt "delay." Rather than utilizing the light stripe/laser line 116, another datum could be employed, for example, a fixed location along the conveyor 102.

Figure 17:
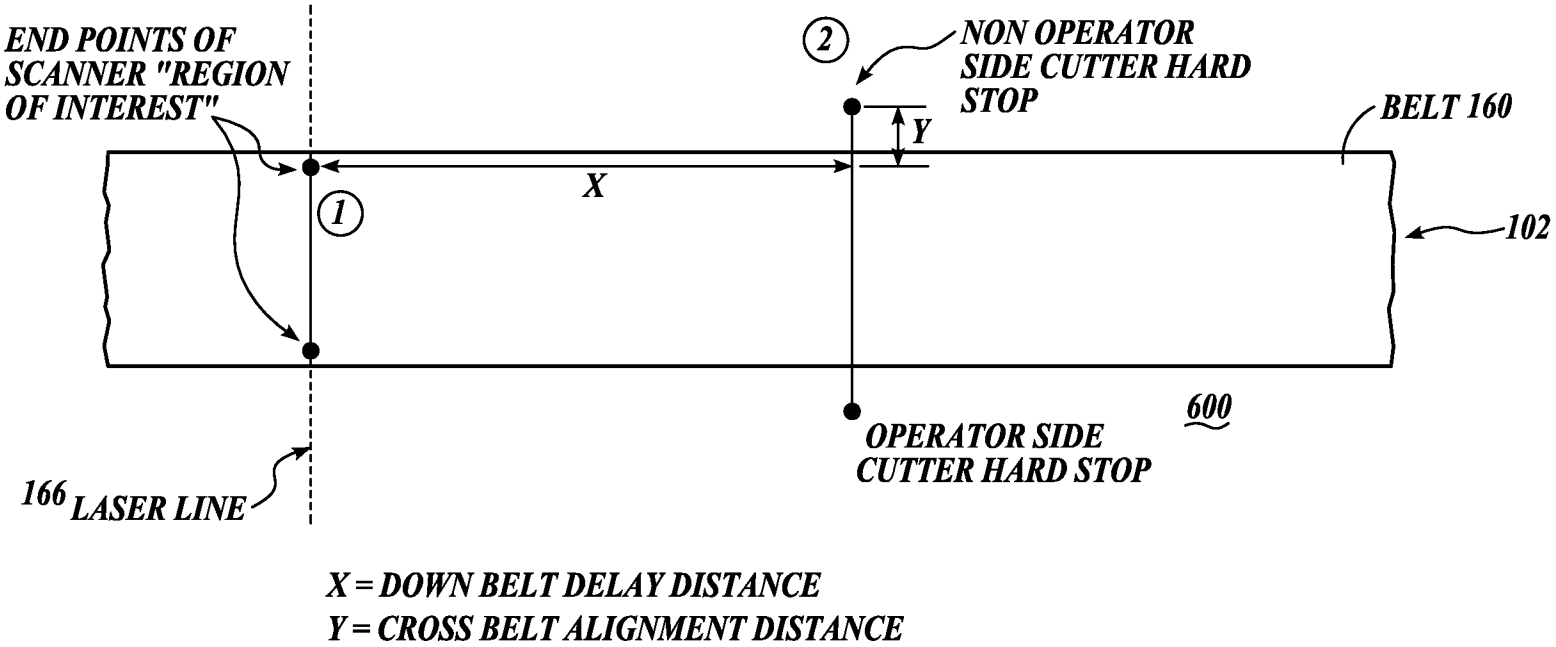
FIG. 17 is a schematic diagram illustrating one possible datum location(s) for calibrating the cutters for the system of FIG. 3.

A datum can also be established with respect to the cross-belt location of the cutter relative to the scanner. As shown in FIG. 17, the cross-belt location of the cutter is calibrated based on the "hard stop" location of the laser line 116 in the direction away from the "operator side" 600 of the belt. This point is identified as point 1 in FIG. 17. This point need not be an actual physical location relative to the scanner, but instead can be a virtual point in the scanning software, having no actual physical correspondence with the scanner.

However, point 2 identified in FIG. 17 does have a physical relevance. Point 2 is the "hard stop" of the cutter in the direction away from the operator side 600. This is the farthest location to which the cutter can travel across the conveyor in the direction away from the operator location 600. This is defined as the "0" location of the cutter. The distance in the direction laterally of the belt separating point 1 and point 2 is identified as dimension "Y." As discussed above, the servo motor 260 used to move the carriage 172 across the belt 160 includes an encoder so that the system 100 always knows the position of the cutter 120 in the cross-belt direction based on the encoder reading.

Figure 15:
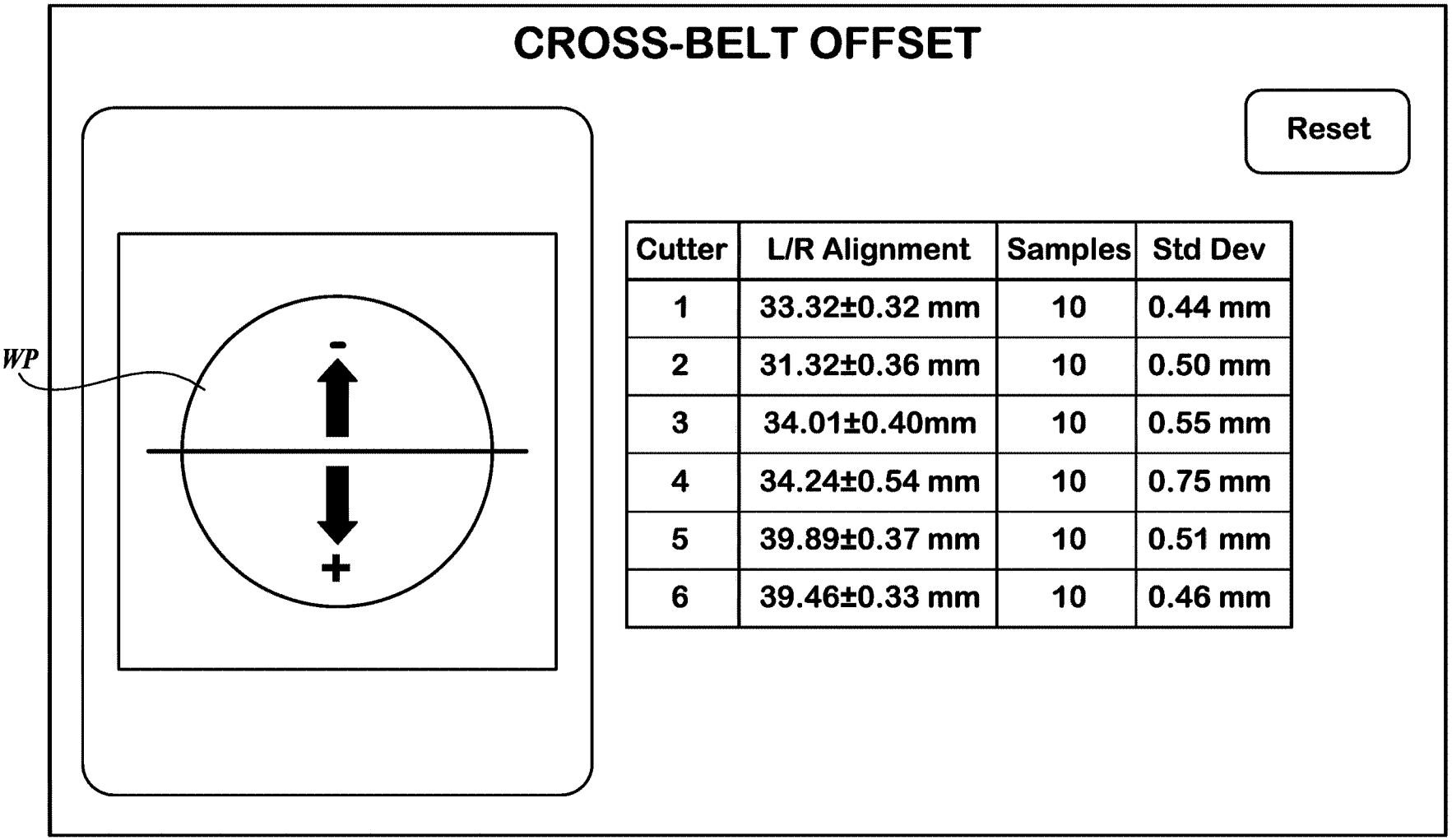
FIG. 15 is a table setting forth the results of calibrating cutters with respect to alignment in the cross-belt direction.

A cutter 120 is calibrated in a cross-belt direction by determining the "Y" dimension as shown in FIG. 17. This dimension will be different from cutter to cutter. In this regard, FIG. 15 is in the form of a table containing results of ten calibration measurements for each of six cutters to determine the "Y" dimension, and thus the cross-belt location of the hard stop location "2" of the cutters. As shown in FIG. 15, the "Y" dimension varies from 31.32 mm for cutter No. 2 to 39.89 mm for cutter No. 5. The measured tolerance for dimension "Y" is also set forth in FIG. 15, as well as the standard deviation of the measured dimension "Y." As discussed above, this information is analyzed by the processor 150, and the lateral offset dimension "Y" for each of the cutters is used to establish the "0" location of the cutter relative to the "1" endpoint of the scanner light or laser line 1.

Figure 16:
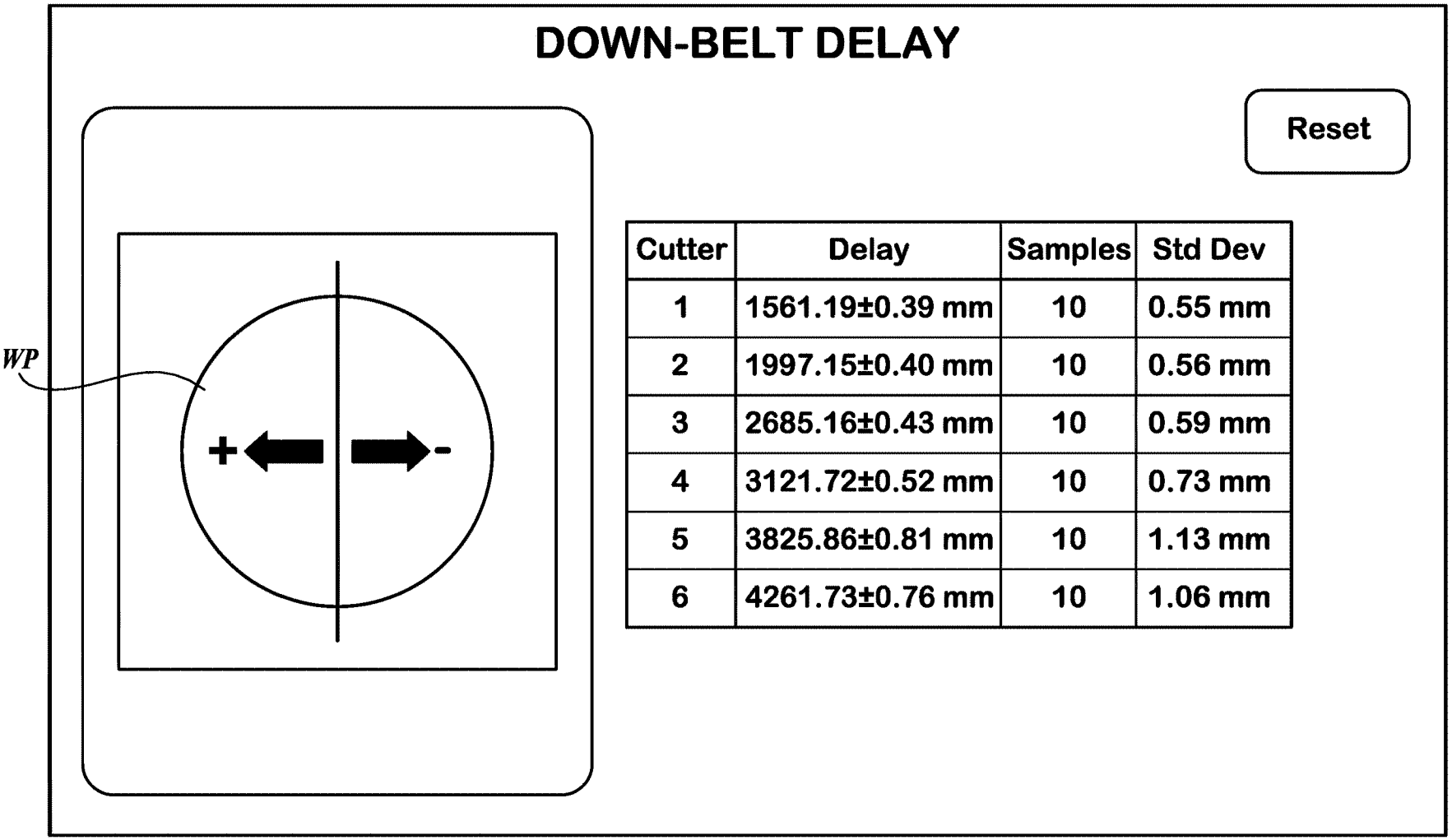
FIG. 16 is a table showing the results of calibrating cutters in the down-belt direction.

FIG. 16 is a table containing the results of ten calibration measurements for each of six cutters to determine the "X" dimension. As noted above, the "X" dimension or distance is the "down-belt" delay of a cutter 120 relative to the laser line 116 of the scanner 110. As shown in FIG. 16, the "X" for cutter No. 1 is 1561.19 mm, which is the cutter closest to the laser line 116. The "X" distance will progressively increase for each subsequent cutter unit 120 located further away from the scanner 110. The furthest located cutter, cutter No. 6, is at a distance of 4261.73 mm from the laser line 116. The measured tolerances for the distance "X" is set forth in FIG. 16, as well as the standard deviation of the measured distance "X." As discussed above, this information is analyzed by the processor 150 and the down-belt delay for each of the cutters is used to establish the "0" location of the cutter in the "X" direction.

While illustrative embodiments have been illustrated and described, it will be appreciated that various changes can be made therein without departing from the spirit and scope of the invention. For example, the portioning system of the present disclosure may apply to virtually any processing system using a scanner to control or position or monitor the location of an actuator configured to act on workpieces carried on a conveyor. In this regard, the actuator can be of a wide variety of devices, including a cutter, a waterjet cutter, an injection needle, a printing head, a painting head, a stamping head, a drilling head, a piercing head, a nailing head, a stapling head, and a laser, to provide some examples.

As a further example, rather than cutting the target that simulates a workpiece, the target might be designated or marked by various techniques, including applying an indicia to the target, forming an indicia on the target, applying paint to the target, applying a design to the target, forming a hole in the target, drilling a hole in the target, piercing the target, burning a shape into the target, and punching a shape into the target.

Moreover, rather than physically marking the target, the target could be virtually marked with the location and configuration or shape, with the virtual marking retained in the memory of the processing system. Thereafter, when the target is rescanned, the location of the virtual marking on the target is retrieved from the computer memory and the calibrating process continues as described herein.

The embodiments of the invention in which an exclusive property or privilege is claimed are defined as follows:

1. A method of calibrating a processing system having a scanner positioned for scanning a workpiece carried on the belt of a longitudinally extending conveyor and a plurality of actuators comprising a set of at least three actuators located and configured to move relative to the conveyor, the system calibrating each of the actuators of the set relative to a datum simultaneously in a cross-belt offset direction and a down belt delay direction, the method comprising:

(a) loading at least one original target simulating a workpiece on the conveyor;

(b) scanning the original target for locating the original target on the conveyor and ascertaining physical parameters of the original target as the original target is transported by the conveyor;

(c) marking the original target with locations or paths of movement of each of the actuators of the set simultaneously in a cross-belt offset direction and a down belt delay direction relative to the same original target as the original target is being transported a single time past the set of actuators by the conveyor;

(d) removing the marked original target from the conveyor;

(e) reloading the marked original target on the conveyor;

(f) rescanning the marked original target to locate the locations or paths of movement of each of the actuators of the set relative to the same original target; and (g) determining and implementing, with a computer processor, the repositioning, if any, of each of the actuators relative to the position of the scanner in a direction laterally of the conveyor and the repositioning, if any, of each of the actuators relative to the scanner in the direction along the length of the conveyor based on the location or path of movement of each of the actuators relative to the same original target.

2. The calibrating method of claim 1, wherein the actuators are selected from a group consisting of a cutter, a water jet cutter, an injection needle, a printing head, a painting head, a stamping head, a drilling head, a piercing head, a nailing head, a stapling head, and a laser.

3. The calibrating method of claim 1, wherein the marking of the original target is performed by a step selected from a group consisting of cutting the original target, cutting a shape in the original target, piercing the original target, applying indicia to the original target; forming an indicia on the original target, applying paint to the original target, applying a design to the original target, forming a hole in the original target; and drilling a hole in the original target, piercing the original target, and burning a shape in the original target.

4. The calibrating method of claim 1, wherein the original target is composed of foamed plastic, foamed thermoplastic, foamed rubber, foamed synthetic rubber, polylactic acid, organic food-based materials, rubber, synthetic rubbers, paper, cardboard or corrugated cardboard.

5. A method of calibrating a plurality of cutters of a portioning system having a scanner located for scanning a workpiece carried on a longitudinally extending conveyor and the plurality of cutters positioned and configured to move laterally relative to the conveyor and along the length of the conveyor, wherein the cutters are simultaneously calibrated relative to a datum in a cross-belt offset direction and in a down belt delay direction, the method comprising:

(a) loading a plurality of targets simulating workpieces on the conveyor;

(b) initially scanning the targets for locating the targets on the conveyor and ascertaining physical parameters of the targets as the targets are transported by the conveyor;

(c) cutting each of the targets sequentially with each of the plurality of cutters in specific cutting patterns on each target purposefully at a different location on each target for each cutter as each target is being transported by the conveyor past the cutters;

(d) removing the cut targets from the conveyor;

(e) reloading the cut targets on the conveyor;

(f) rescanning the cut targets to analyze positions of the cutting patterns relative to the targets; and (g) based on the position of the cutting patterns simultaneously determining and adjusting, with a computer processor, the calibration of each of the cutters relative to the position of the scanner in a direction laterally of the conveyor and the calibration of each of the cutters relative to the scanner in a direction along the length of the conveyor, based on the analyzed positions of the cutting patterns made by the plurality of cutters on each of the targets.

6. The calibrating method according to claim 5, wherein the plurality of targets are spaced apart along the length of the conveyor.

7. The calibrating method according to claim 5, wherein the plurality of targets are spaced apart across the width of the conveyor.

8. The calibrating method according to claim 5, wherein the specific cutting patterns comprise shapes cut in each of the targets with the plurality of cutters.

9. The calibrating method according to claim 8, wherein the shapes cut from the targets are arranged in a specific pattern on the targets.

10. The calibrating method according to claim 8, wherein the shapes cut from the targets are arranged along the direction of travel of the conveyor.

11. The calibrating method according to claim 8, wherein the shapes cut from the targets are arranged parallel to one side of the conveyor.

12. The calibrating method according to claim 8, wherein the shapes cut in the targets are removed from the targets prior to reloading the targets on the conveyor.

13. The calibrating method according to claim 5, wherein cutting of each of the targets with the plurality of cutters comprises cutting preselected shapes in the targets.

14. The calibrating method according to claim 5, wherein each of the cutters cut a unique shape on the targets.

15. The calibrating method according to claim 5, further comprising configuring the portioning system to recognize upon rescanning of the targets each specific target originally scanned by the scanner and then cut by each cutter.

16. The calibrating method according to claim 15, wherein the portioning system recognizes one or more physical parameters of the targets ascertained by the portioning system when originally scanned by the scanner.

17. The calibrating method according to claim 16, wherein the physical parameters comprise indicia located on the targets or aspects of the pattern cut into the targets.

18. The calibrating method according to claim 17, wherein aspects of the pattern cut into the targets comprise unique patterns cut into each of the targets by each of the cutters.

19. The calibration method according to claim 16, further comprising analyzing the physical parameters of the targets upon the rescanning of the targets to match the rescanned targets to the corresponding initially scanned targets.

20. The calibration method according to claim 16, further comprising carrying out a transformation of the physical parameters of the targets ascertained during the initial scanning of the targets to the physical parameters of the targets ascertained during the rescanning of the targets to assist in analyzing the position of the cutting pattern relative to the targets.

21. The calibration method according to claim 5, wherein calibrating the plurality of cutters comprises determining the positions of the cutters during cutting of the specific patterns in the same target and storing determined positions of the cutters during cutting.

22. The calibration method according to claim 21, wherein determining the positions of the cutters is based on determining the locations of a physical attribute of the specific pattern cut in the targets.

23. The calibration method according to claim 5, wherein:

the conveyor having a width; and the positions of the cutters are calibrated at a plurality of locations across the width of the conveyor.

24. The calibrating method according to claim 5, further comprising establishing a datum relative to the location of the scanner for the location of the cutters in the direction laterally to the direction of movement of the conveyor.

25. The calibrating method according to claim 5, further comprising establishing a datum relative to the location of the scanner for the location of the cutters in the direction along the direction of movement of the conveyor.

* * * * *